US012630202B2

(12) United States Patent
Ono et al.

(10) Patent No.: US 12,630,202 B2
(45) Date of Patent: May 19, 2026

(54) RAIL TRANSPORTATION SYSTEM, METHOD FOR CONTROLLING RAIL TRANSPORTATION SYSTEM, AND TRACKSIDE FACILITY SHAPE MEASUREMENT SYSTEM

(71) Applicant: Hitachi, Ltd., Tokyo (JP)

(72) Inventors: Yukihiko Ono, Tokyo (JP); Kenji Imamoto, Tokyo (JP); Jun Koike, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 337 days.

(21) Appl. No.: 18/250,588

(22) PCT Filed: Oct. 15, 2021

(86) PCT No.: PCT/JP2021/038244

§ 371 (c)(1),
(2) Date: Apr. 26, 2023

(87) PCT Pub. No.: WO2022/091817

PCT Pub. Date: May 5, 2022

(65) Prior Publication Data

US 2023/0415800 A1 Dec. 28, 2023

(30) Foreign Application Priority Data

Oct. 28, 2020 (JP) ..... 2020-180352

(51) Int. Cl.
*B61L 25/06* (2006.01)

(52) U.S. Cl.
CPC ..... *B61L 25/06* (2013.01)

(58) Field of Classification Search
CPC ..... B61L 23/041; B61L 25/025; B61L 23/04; B61L 25/06; B61L 15/0072
See application file for complete search history.

(56) References Cited

U.S. PATENT DOCUMENTS

2010/0034426 A1 2/2010 Takiguchi et al.
2017/0066459 A1 3/2017 Singh
2020/0349743 A1 11/2020 Kitamura et al.

FOREIGN PATENT DOCUMENTS

EP 3 722 182 A1 10/2020
JP 2017-001638 A 1/2017
(Continued)

OTHER PUBLICATIONS

International Search Report with English Translation and Written Opinion of International Patent Application No. PCT/JP2021/038244 dated Dec. 14, 2021 (9 pages).
(Continued)

*Primary Examiner* — An H Do
(74) *Attorney, Agent, or Firm* — Foley & Lardner LLP

(57) ABSTRACT

A track transportation system including a surrounding environment observation unit is provided. The surrounding environment observation unit is installed on a train and obtains surrounding environment observation data by observing a surrounding environment for while the train is traveling and includes trackside equipment. The track transportation system includes a trackside equipment shape measurement system that obtains a three-dimensional shape for the trackside equipment by overlapping, on the basis of a track for a rail, a plurality of items of the surrounding environment observation data that include the trackside equipment and have been obtained at a plurality of positions on the track.

17 Claims, 32 Drawing Sheets

(56) References Cited

FOREIGN PATENT DOCUMENTS

| | | | |
|---|---|---|---|
| JP | 2017-196948 | A | 11/2017 |
| KR | 20180061929 | A | 6/2018 |
| WO | WO-2008/099915 | A1 | 8/2008 |
| WO | WO-2019/138716 | A1 | 7/2019 |

OTHER PUBLICATIONS

Extended European Search Report issued in corresponding EP Application No. 21885936.1, dated Aug. 22, 2024 (9 pages).
Indian Examination Report issued in corresponding IN Application No. 202317036220 dated Oct. 30, 2025 (11 Pages).

RAIL TRANSPORTATION SYSTEM, METHOD FOR CONTROLLING RAIL TRANSPORTATION SYSTEM, AND TRACKSIDE FACILITY SHAPE MEASUREMENT SYSTEM

TECHNICAL FIELD

The present invention pertains to a track transportation system, a method of controlling a track transportation system, and a trackside equipment shape measurement system.

BACKGROUND ART

Remote monitoring of railway trackside equipment by a running train leads to cost reductions for operation and maintenance in a railway business, and is also important in order to quickly discover obstacles for train operation.

As such a method of remote monitoring for railway trackside equipment, there is, inter alia, a method described in Patent Document 1 for detecting environment change in time series by capturing around a railway by a camera installed on a train, and making a comparison with a camera image resulting from capturing the same line at a different datetime, for example.

However, in order to investigate an anomaly in certain trackside equipment, there are cases where this trackside equipment must be checked from multiple directions, and three-dimensional measurement is necessary at this time instead of just image capturing from a certain direction by a camera.

As a method for performing three-dimensional measurement by a camera, Patent Document 2 describes, inter alia, a method for capturing a target object from a plurality of locations and obtaining three-dimensional coordinates or a shape for the target object using triangulation, a method using a stereo camera system that performs image capturing after preparing a plurality of cameras, and a method for obtaining, on the basis of a SfM (Structure from Motion) technique, a three-dimensional shape of a photographic subject from a plurality of captured images that have been captured by a camera mounted to a vehicle while the vehicle has been moving.

In addition, as described in Patent Document 3, there is a method for using a LIDAR device mounted to a vehicle to obtain a point cloud while the vehicle is moving, converting the obtained point cloud from positions in a vehicle coordinate system to positions in an external coordinate system, storing the converted point cloud, and obtaining a three-dimensional shape of a target object from the stored point cloud information.

Furthermore, it is possible to use so-called three-dimensional LIDAR to obtain a three-dimensional shape of a target object even if there is no position information for a vehicle.

PRIOR ART DOCUMENT

Patent Documents

Patent Document 1: JP-2017-001638-A
Patent Document 2: JP-2017-196948-A
Patent Document 3: PCT Patent Publication No. WO2008/099915

SUMMARY OF THE INVENTION

Problem to be Solved by the Invention

FIG. 1 is a schematic view that illustrates an example of measurement using a sensor installed on the front surface of a leading vehicle, and FIG. 2 is a schematic view that illustrates an example of measurement using a sensor installed on the top of a leading vehicle.

As in FIG. 1, in a case where a three-dimensional shape for a target object is measured by a sensor group installed on the front surface of a leading vehicle belonging to a transport vehicle 102, it is only possible to measure the shape of limited portions of target objects.

In addition, as in FIG. 2, there is a method of installing a sensor group in a surrounding environment observation unit 107 on the top of a vehicle to thereby enlarge a target object measurement region, but there are problems such as the sensor group is installed at a high place and maintenance of the sensor group is difficult.

The present invention is made in consideration of these points, and thus an objective of the present invention is to provide a track transportation system, a method of controlling a track transportation system, and a trackside equipment shape measurement system that can check for an anomaly for railway trackside equipment from multiple viewpoints.

Means for Solving the Problem

In order to solve the problems described above, one representative track transportation system according to the present invention is provided with: a surrounding environment observation unit that is installed on a train and obtains surrounding environment observation data by observing a surrounding environment that is for while the train is traveling and includes known trackside equipment; and a trackside equipment shape measurement system that obtains a three-dimensional shape for the trackside equipment by overlapping, on the basis of a track for a rail, a plurality of items of the surrounding environment observation data that include the trackside equipment and have been obtained at a plurality of positions on the track.

Advantages of the Invention

By virtue of the present invention, it is possible to provide a track transportation system, a method of controlling a track transportation system, and a trackside equipment shape measurement system that can check railway trackside equipment from multiple viewpoints, and can quickly detect an anomaly for the railway trackside equipment.

Problems, configurations, and effects other than those described above are clarified by the following description of embodiments.

MODES FOR CARRYING OUT THE INVENTION

With reference to the drawings, description is given below regarding embodiments.

First Embodiment

Figure 1:
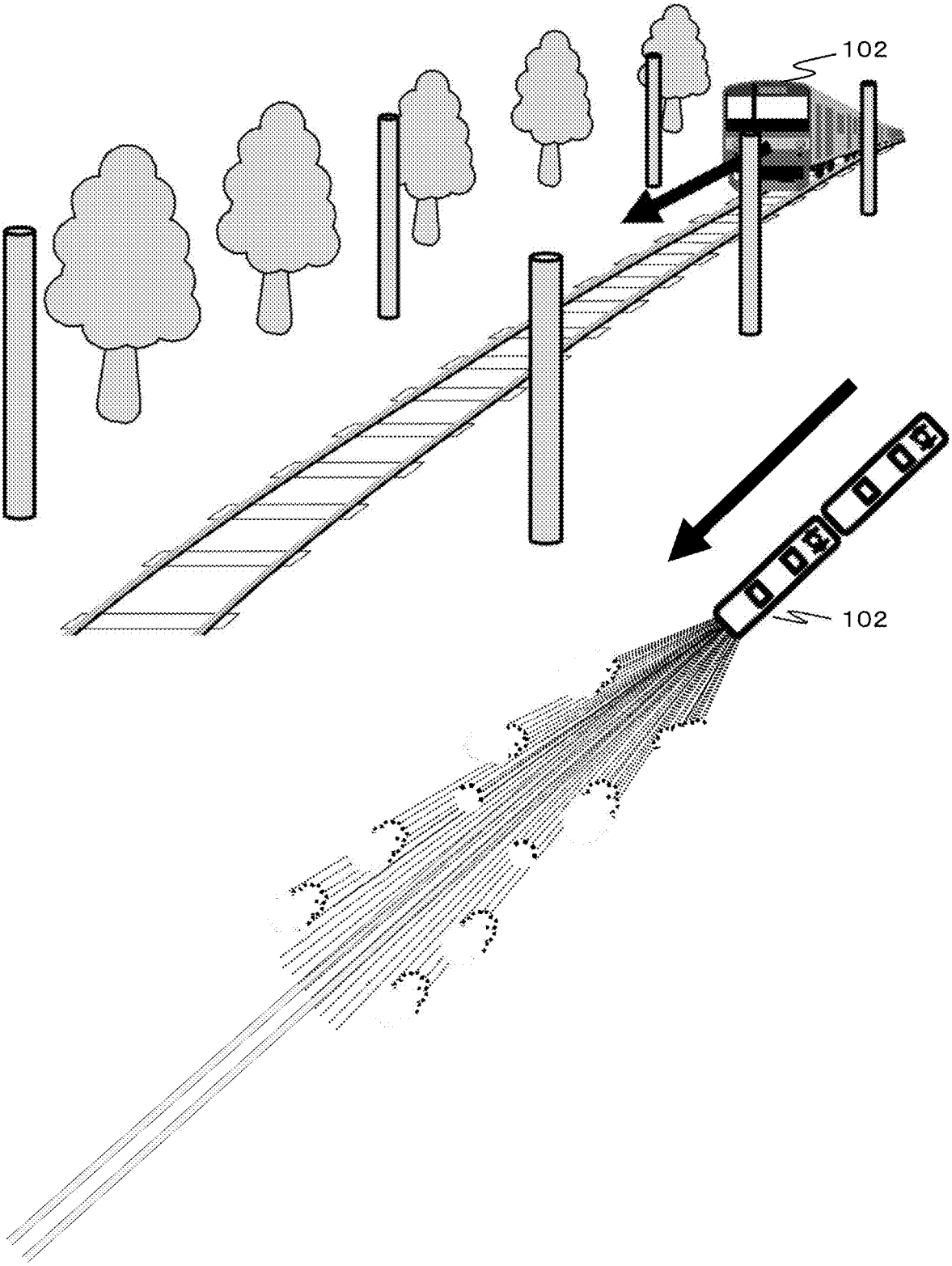
FIG. 1 is a schematic view that illustrates an example of measurement using a sensor installed on the front surface of a leading vehicle.
Figure 2:
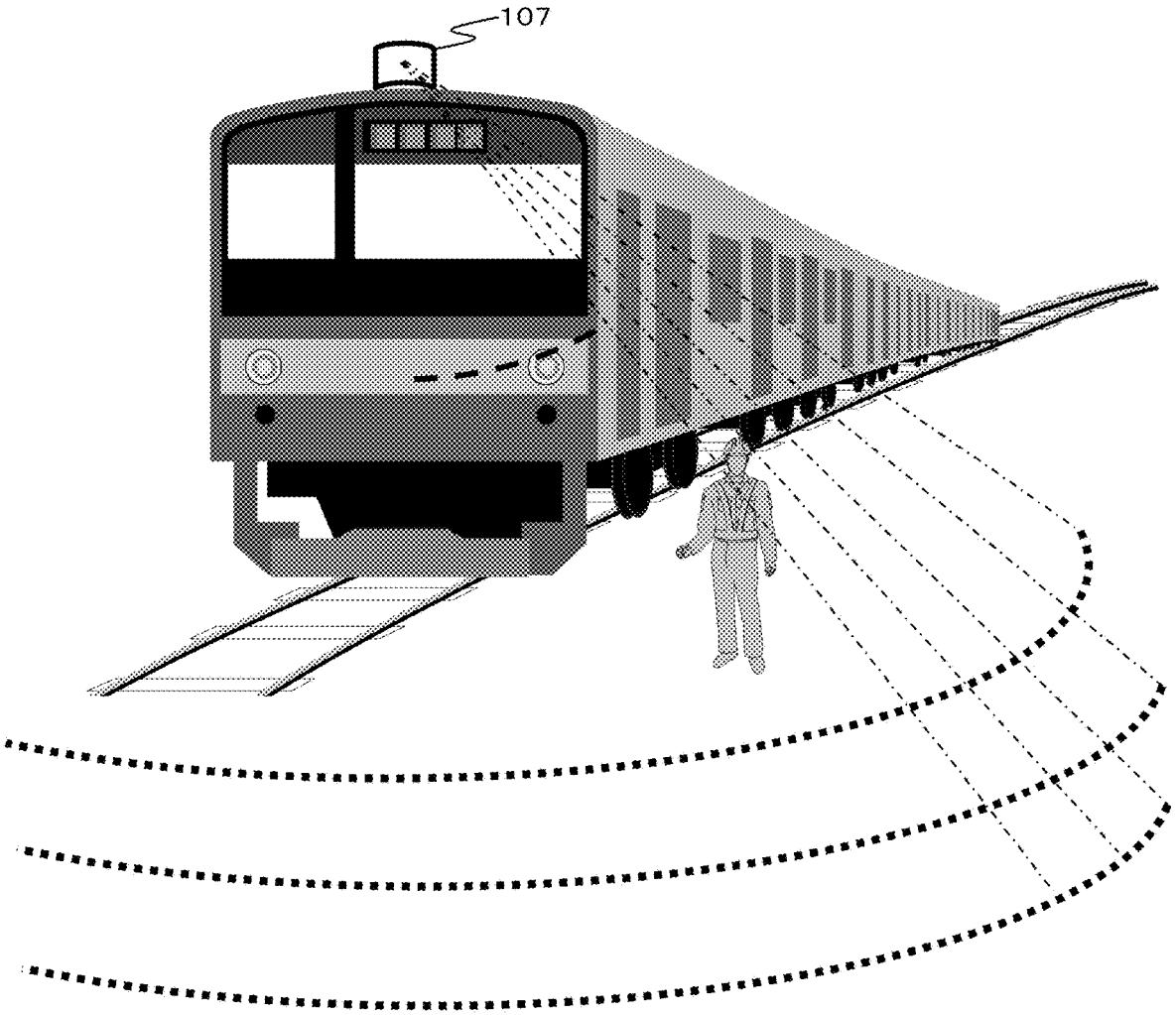
FIG. 2 is a schematic view that illustrates an example of measurement using a sensor installed on the top of a leading vehicle.
Figure 3:
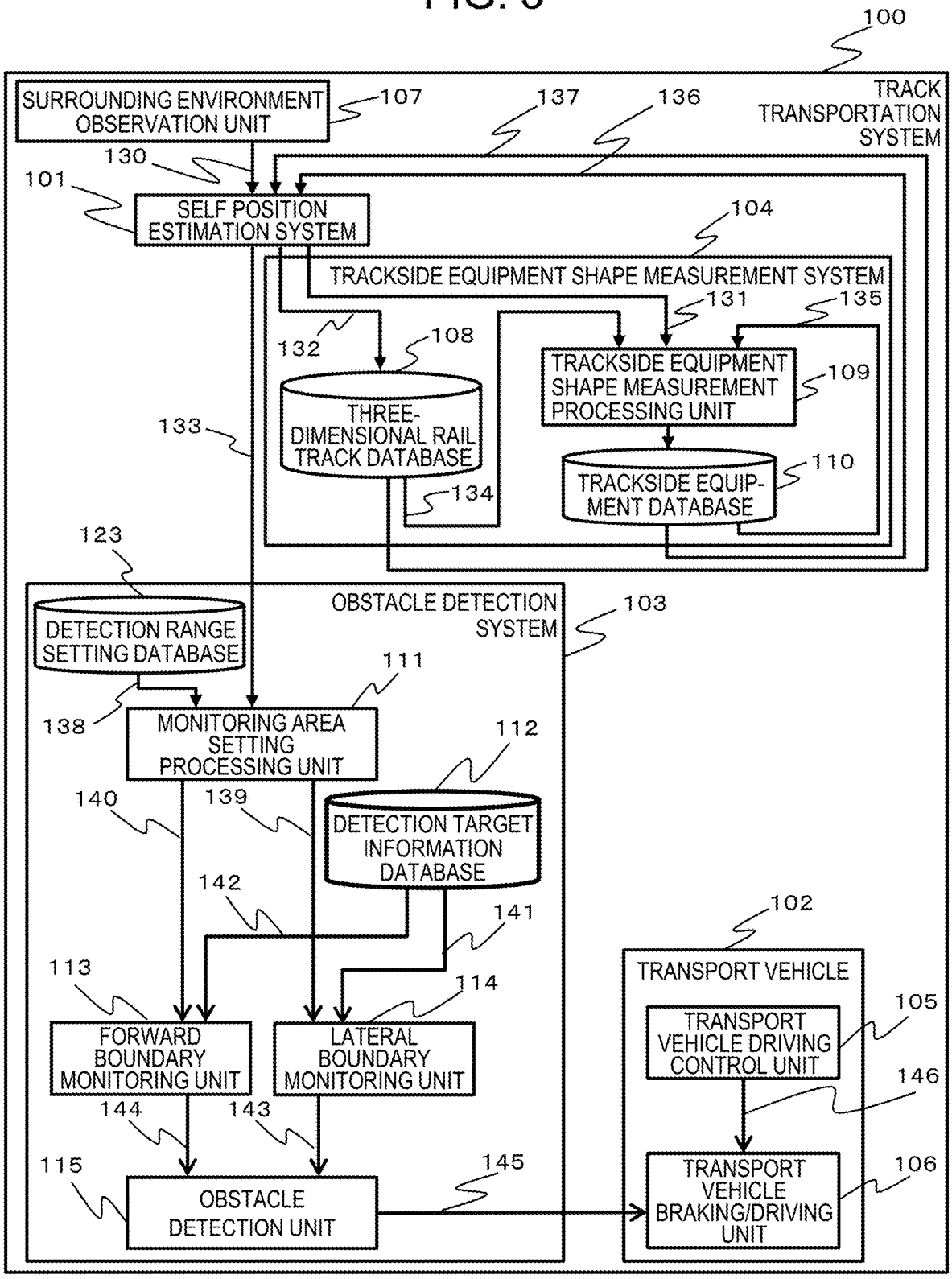
FIG. 3 is a view that illustrates an example of a configuration of a track transportation system.

FIG. 3 is a view that illustrates an example of a configuration of a track transportation system.

In the present embodiment, description is given regarding a track transportation system 100 configured from a transport vehicle 102, a self position estimation system 101, a surrounding environment observation unit 107, an obstacle detection system 103, and a trackside equipment shape measurement system 104.

(Configuration of Track Transportation System 100 and Role of Each Component)

Firstly, using FIG. 3, the configuration of the track transportation system 100 and the role of each component is described.

The transport vehicle 102 travels along a track and transports passengers or cargo.

The surrounding environment observation unit 107 is installed at the front and rear of the transport vehicle 102, obtains, inter alia, the position, shape, color, or reflection intensity of an object in the surroundings of the transport vehicle 102, and is configured from, inter alia, a camera, a laser radar, or a millimeter-wave radar.

The obstacle detection system 103 detects an obstacle on the basis of position and orientation information 133 for the transport vehicle 102 obtained from the self position estimation system 101.

In a case where the obstacle detection system 103 has detected an obstacle that will cause an impediment for travel by the transport vehicle 102, information pertaining to the presence of the obstacle is sent from the obstacle detection system 103 to the transport vehicle 102, and the transport vehicle 102 performs an emergency stop.

The obstacle detection system 103 is configured from a detection range setting database 123, a monitoring area setting processing unit 111, a detection target information database 112, a lateral boundary monitoring unit 114, a forward boundary monitoring unit 113, and an obstacle detection unit 115.

The monitoring area setting processing unit 111 obtains, from the detection range setting database 123, an obstacle detection range 138 corresponding to the position and orientation information 133 for the transport vehicle estimated by the self position estimation system 101, and sets an obstacle monitoring area for detecting obstacles.

For example, consideration can be given to, inter alia, registering within a structure gauge as a detection range in the detection range setting database 123 and exceptionally registering, as areas for which detection is not to be performed, areas that are for performing maintenance work as well as near platforms.

The lateral boundary monitoring unit 114 and the forward boundary monitoring unit 113 have functionality that uses, inter alia, cameras, laser radar, or millimeter-wave radar to detect obstacles in boundary detection regions 139 and 140 set at a lateral boundary and a forward boundary in the obstacle monitoring area. Here, the lateral boundary monitoring unit 114 and the forward boundary monitoring unit 113 may use a sensor in the surrounding environment observation unit 107 as an obstacle detection sensor.

A position and reflectance for an existing object (such as a rail or a sign) having a detection rate of a certain value or higher can be recorded in the detection target information database 112 in advance.

The obstacle detection unit 115 can detect an obstacle within the obstacle monitoring area on the basis of monitoring results 144 and 143 by the lateral boundary monitoring unit 114 and the forward boundary monitoring unit 113.

In a case of detecting an obstacle that will lead to an impediment for operation by the transport vehicle 102, the obstacle detection unit 115 transmits information "obstacle: present" to the transport vehicle braking/driving unit 106 in the transport vehicle 102.

Figure 4:
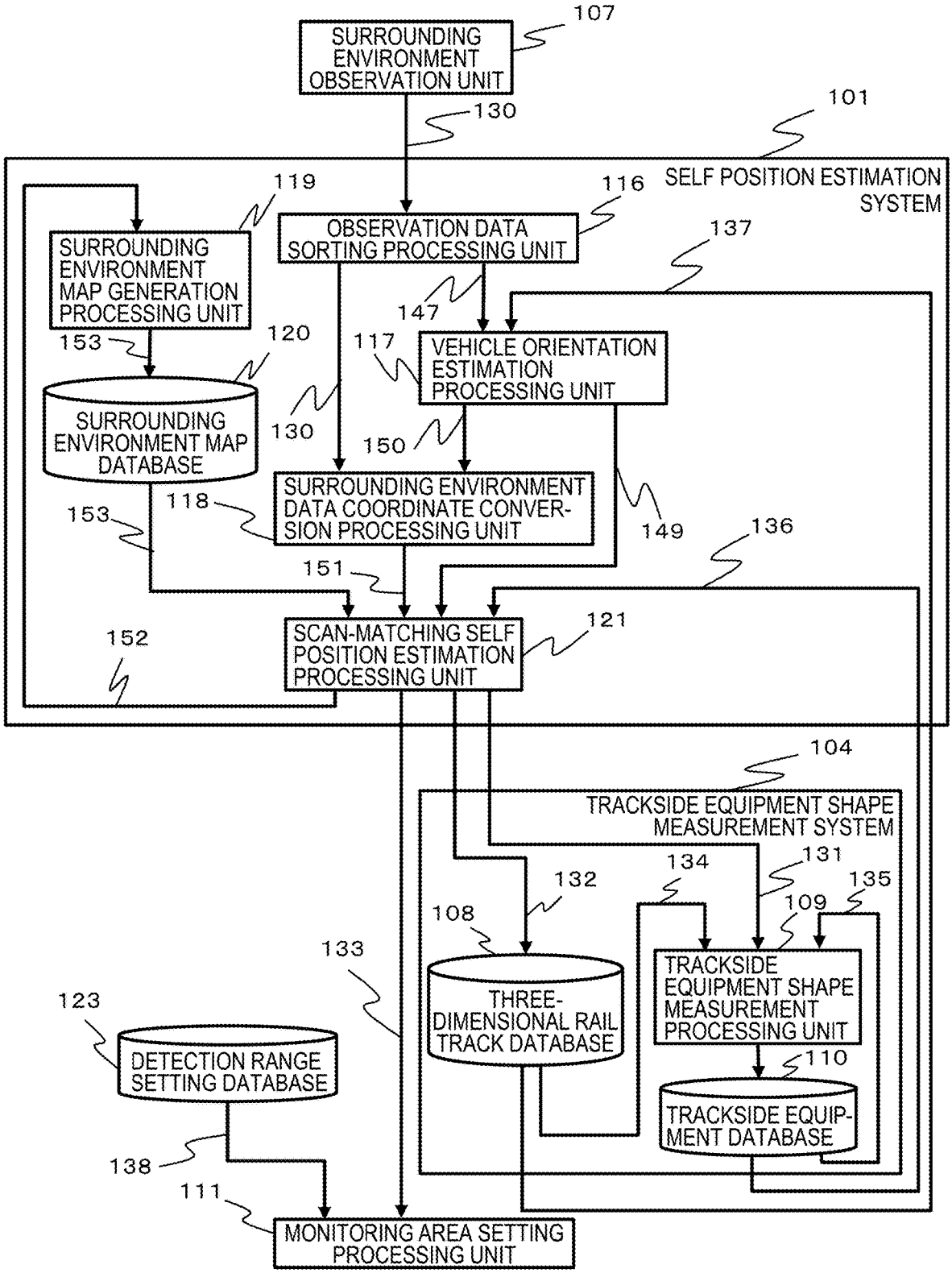
FIG. 4 is a view that illustrates an example of a configuration of a self position estimation system and a trackside equipment shape measurement system.

FIG. 4 is a view that illustrates an example of a configuration of the self position estimation system 101 and the trackside equipment shape measurement system 104.

The self position estimation system 101 is configured from an observation data sorting processing unit 116, a vehicle orientation estimation processing unit 117, a surrounding environment data coordinate conversion processing unit 118, a surrounding environment map generation processing unit 119, a surrounding environment map database 120, and a scan-matching self position estimation processing unit 121.

The self position estimation system 101 uses scan matching to estimate the position and orientation of the transport vehicle 102 in an external coordinate system on the basis of surrounding environment observation data 130 obtained by the surrounding environment observation unit 107 and a surrounding environment map database 120 or a three-dimensional rail track database 108 which are defined in the external coordinate system.

The observation data sorting processing unit 116 can sort rail observation data 147 from the surrounding environment observation data 130 observed by the surrounding environment observation unit 107.

The vehicle orientation estimation processing unit 117 can estimate the orientation of the transport vehicle 102 from the rail observation data 147 and rail position information 137 obtained from the three-dimensional rail track database 108.

The surrounding environment data coordinate conversion processing unit 118 can use the vehicle orientation 150 to convert the surrounding environment observation data 130 from a vehicle coordinate system fixed to the transport vehicle 102 to the external coordinate system in which the surrounding environment map database 120 and the three-dimensional rail track database 108 are defined, and achieve surrounding environment measurement data 151 (hereinafter, surrounding environment observation data that has been converted to the external coordinate system may be referred to as "surrounding environment measurement data").

The scan-matching self position estimation processing unit 121 can estimate the self position of the vehicle by performing scan matching between the surrounding environment measurement data 151 and surrounding environment map data 153 recorded in the surrounding environment map database 120 while using the rail position information 137 to cause movement on the track recorded in the three-dimensional rail track database 108 and while maintaining a vehicle orientation 149. At this time, trackside equipment information 136 which has been recorded to the trackside equipment database 110 may be used.

The surrounding environment map generation processing unit 119 can generate the surrounding environment map data 153 from surrounding environment measurement data 152.

The trackside equipment shape measurement system 104 is configured from the three-dimensional rail track database 108, a trackside equipment shape measurement processing unit 109, and the trackside equipment database 110.

On the basis of point cloud data that from the scan-matching self position estimation processing unit 121, is for trackside equipment, and has been converted to the external coordinate system, the trackside equipment shape measurement system 104 measures a three-dimensional shape for trackside equipment by the trackside equipment shape measurement processing unit 109, and records the three-dimensional shape in the trackside equipment database 110.

The three-dimensional rail track database 108 can record rail measurement data 132.

From surrounding environment measurement data 131, a rail shape model 134, and trackside equipment information 135, the trackside equipment shape measurement processing unit 109 can detect trackside equipment within surrounding environment measurement data 131, and create a three-dimensional shape model for the trackside equipment.

The trackside equipment database 110 can record the surrounding environment measurement data 131 in which trackside equipment has been detected, and the three-dimensional shape model for the trackside equipment.

The transport vehicle 102 is configured from a transport vehicle driving control unit 105 and a transport vehicle braking/driving unit 106.

The transport vehicle driving control unit 105 is an apparatus that generates a braking/driving command for the transport vehicle 102, and an ATO apparatus (automatic train operation apparatus) is given as an example. A generated transport vehicle braking/driving command 146 is transmitted to the transport vehicle braking/driving unit 106.

The transport vehicle driving control unit 105 can generate a braking/driving command such that the transport vehicle 102 travels, following a target travel pattern defined by position and speed. Although not illustrated in FIG. 3, a function for detecting the position and speed of the transport vehicle 102 in order to travel by following the target travel pattern is held internally.

Generating a target travel pattern is based on a pattern that is based on acceleration/deceleration and a travel section speed limit for the transport vehicle 102 which are known in advance. Moreover, an allowable maximum speed for the transport vehicle 102 is calculated from the position of the transport vehicle 102 and a maximum deceleration for the transport vehicle 102, and is reflected to the target travel pattern for the transport vehicle 102.

The transport vehicle braking/driving unit 106 performs braking and driving for the transport vehicle 102 on the basis of the transport vehicle braking/driving command 146 obtained from the transport vehicle driving control unit 105. An inverter, motor, friction brake, or the like may be given as an example of a specific apparatus for the transport vehicle braking/driving unit 106.

In addition, obstacle detection information 145 from the obstacle detection unit 115 is inputted to the transport vehicle braking/driving unit 106. In a case where the transport vehicle 102 is stopped at a station and content in the obstacle detection information 145 is "obstacle: present", the transport vehicle 102 is made to enter a braking state and not be able to depart. In a case where the transport vehicle 102 is traveling between stations and content in the obstacle detection information 145 is "obstacle: present", braking is performed at the maximum deceleration, and the transport vehicle 102 is caused to stop.

The above is a description of the configuration of track transportation system 100 and the role of each component.

(Operation by Obstacle Detection System 103)

Figure 5:
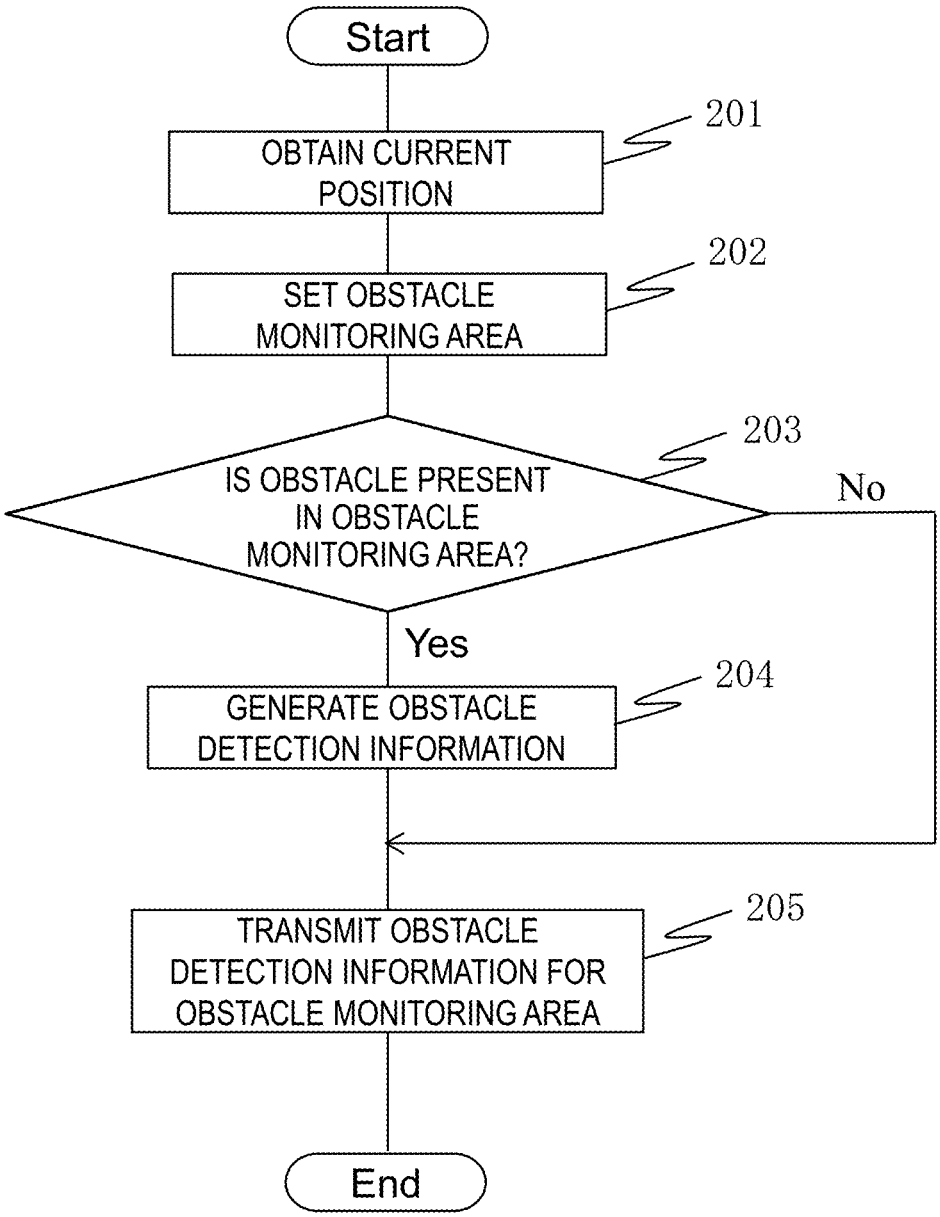
FIG. 5 is a flow chart that illustrates an example of a processing procedure for an obstacle detection system.

Next, operation by the obstacle detection system 103 is described. FIG. 5 is a flow chart that illustrates an example of a processing procedure that is executed by the obstacle detection system 103.

In steps 201 through 205, a stop instruction for the transport vehicle 102 is created. The present processing is executed each sensing cycle for an obstacle detection sensor.

In step 201, the current position and orientation 133 of the transport vehicle 102, which is necessary for obtaining the obstacle detection range 138, is obtained from the self position estimation system 101.

In step 202, an obstacle monitoring area is set from the obstacle detection range 138 corresponding to the current position of the transport vehicle obtained in step 201.

For example, consideration can be given to, inter alia, setting a structure gauge as a lateral boundary for the obstacle monitoring area and setting a stop-possible distance for the transport vehicle as a travel direction boundary for the obstacle monitoring area.

In step 203, sensor information pertaining to obstacles in the boundary detection regions 139 and 140 set at the boundary of the obstacle monitoring area is obtained from the obstacle detection sensor, and a determination whether there is an obstacle in the obstacle monitoring area is made. In a case where it is determined that there is an obstacle as a result of having determined whether there is an obstacle in step 203, step 204 is advanced to. Step 205 is advanced to in a case where it is determined that there is no obstacle.

In consideration of the size and maximum movement speed of an obstacle that is envisioned to intrude into these regions and the sensing cycle of the obstacle detection sensor, the width of the lateral boundary detection region 139 is set to a width that can be detected at least one time when the obstacle enters within the boundary.

It is desirable for the width of this lateral boundary detection region 139 to change in response to the current position of the transport vehicle 102, for example by being set to several cm to several tens of cm (more specifically, 10 cm) at a station by envisioning passengers waiting at a platform, being set wider (for example, 1 m) near a level crossing by envisioning crossing by an automobile or the like, etc.

Figure 6:
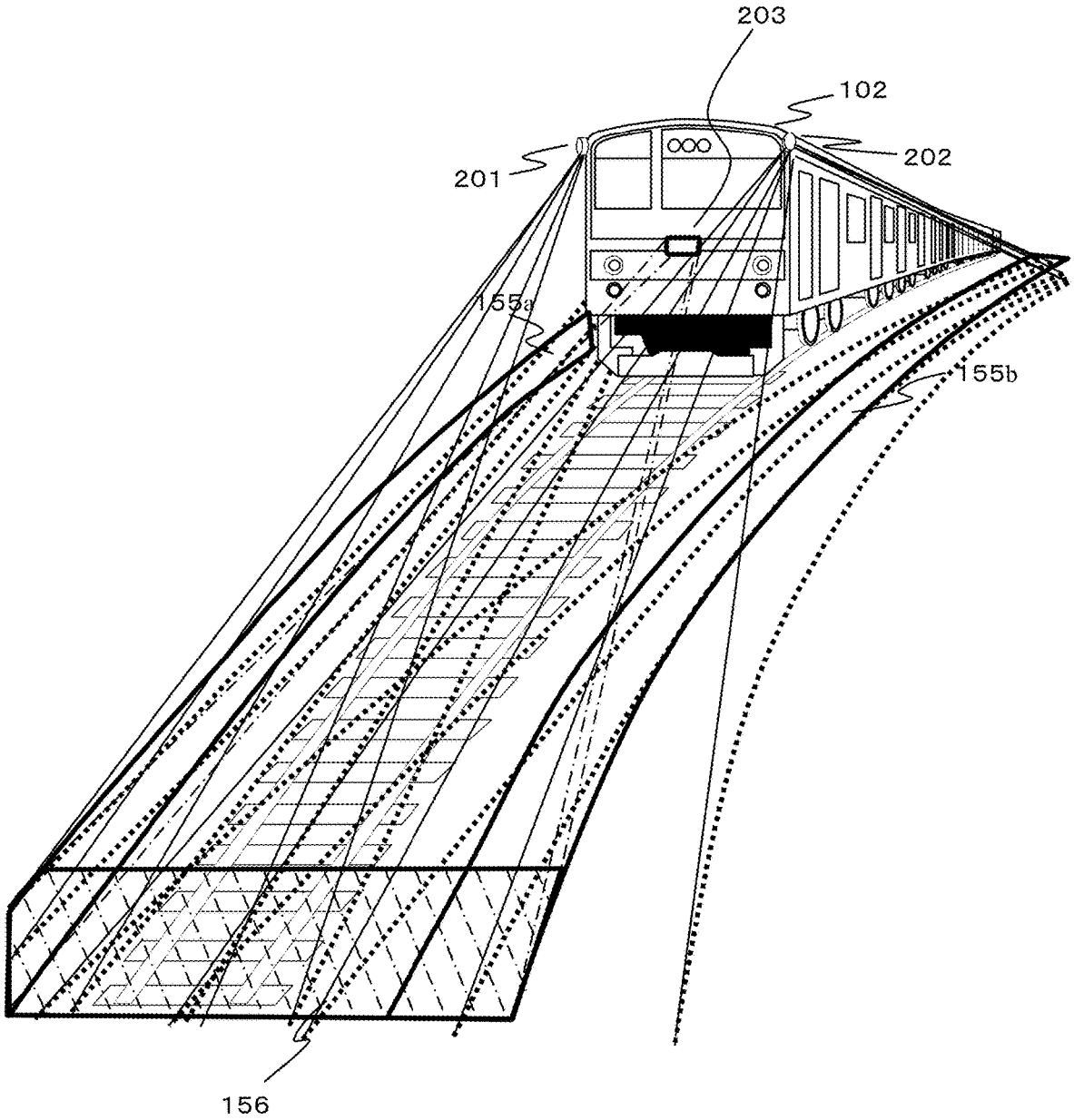
FIG. 6 is a view that illustrates an example of sensor installation.

FIG. 6 is a view that illustrates an example of sensor installation.

As a sensor that detects whether there is a lateral obstacle in lateral boundary detection regions 155, considering that the shape of a lateral boundary detection region 155 is a rectangle having a width of several tens of cm and a depth of more than one hundred m, it is possible to use detectors 201 and 202 which are two LIDAR devices installed facing forward and downward at high positions on the left and right at the front of the transport vehicle 102 such that it is possible to detect the left and right lateral boundary detection regions 155 as in FIG. 6. Here, a detection result for within a lateral boundary detection region 155 is compared with lateral detection target information 141 registered in the detection target information database 112 and, when any of the following (condition 1) through (condition 3) is satisfied, it is determined that an obstacle has intruded.

(Condition 1) A known detection point in a lateral boundary detection region 155 is not detected. (Condition 2) The position of a detection point in a lateral boundary detection region 155 differs from a known detection point position. (Condition 3) The reflectance of a detection point in a lateral boundary detection region 155 differs from a known detection point reflectance.

Here, as the speed of the transport vehicle 102 increases, the stopping distance of the transport vehicle 102 extends and the obstacle monitoring area enlarges. In a case where there is low laser reflectance for a detection target that is at a long distance, there is the risk of mistakenly determining that an obstacle has intruded in accordance with condition 1. Accordingly, for example, an allowed travelable speed must be constrained.

Accordingly, in order to avoid constraining the allowed travelable speed, the following (countermeasure 1) and (countermeasure 2) are considered.

(Countermeasure 1) Only the position of an existing object (such as a rail or a sign) having a detection rate of a certain value or more is set to a detection target in a lateral boundary detection region 155. (Countermeasure 2) An object having a detection rate of a certain value or more is installed as a detection target in a lateral boundary detection region 155. For example, an object having a high reflectance, an object to which fouling is less likely to adhere, or the like has a high detection rate.

In any case, the position and reflectance of a detection target is recorded in advance in the detection target information database 112, and this detection target is used for determining obstacle intrusion only in a case where the position of the detection target is included in a lateral boundary detection region 155 for the current position of the transport vehicle 102.

Figure 7:
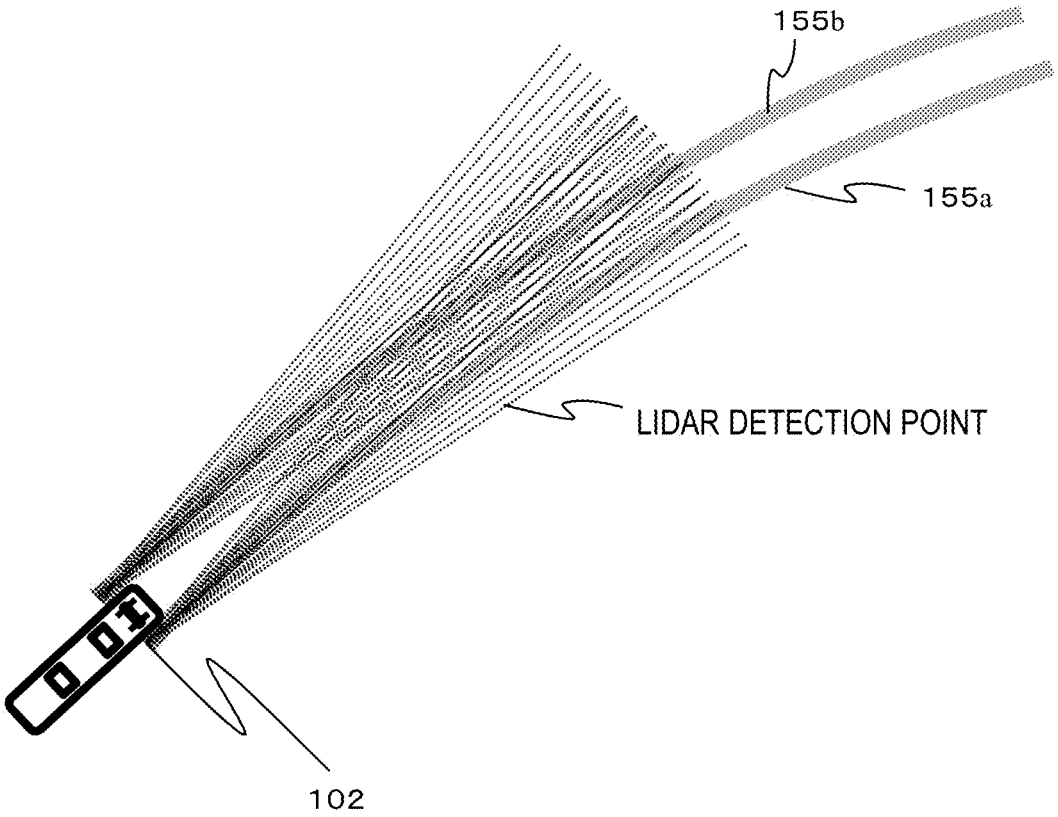
FIG. 7 is a view that illustrates an example of detection of lateral boundary detection regions by the obstacle detection system at a time of traveling on a turning track.

FIG. 7 is a view that illustrates an example of detection for lateral boundary detection regions by the obstacle detection system at a time of traveling on a turning track.

As indicated by a plurality of straight lines in FIG. 6 or FIG. 7, in a case where a multilayer type LIDAR device is used as an obstacle detection sensor, detection points in lateral boundary detection regions 155 spanning a plurality of layers are used, whereby it is possible to determine intrusion by an obstacle even in a case where boundaries are curved as with a curved track.

FIG. 7 uses dotted lines to indicate road surface detection points in accordance with each detection layer irradiated by the multilayer type LIDAR device, but detection layers that pass through the lateral boundary detection regions 155*a* and 155*b* differ in accordance with the distance from the vehicle, and the detection points in the plurality of layers are monitored to determine the intrusion of an obstacle.

At this time, even in a case where a LIDAR detection point is present in a lateral boundary detection region 155, the detection point is not used to determine an intrusion by an obstacle in a case where a straight line (light path of laser) joining the detection point with the LIDAR device passes outside of the lateral boundary detection region 155. This is in order to prevent a misdetection due to an object outside of the lateral boundary detection regions 155.

Note that it may be that a plurality of stereo cameras, millimeter-wave radars, or laser rangefinders are used to detect the lateral boundary detection regions 155, and these sensors are attached to an automatic pan head to thereby scan the lateral boundary detection regions 155.

As a sensor for detecting whether there is a forward obstacle in a forward boundary detection region 156, consideration can be given to a narrow-angle monocular camera (including infrared), a stereo camera, a millimeter-wave radar, a LIDAR device, a laser rangefinder, or the like.

It may be that a plurality of these different types of sensors are used to determine that an obstacle is present in a monitoring area by a detection result for any sensor (color, detection position or distance, laser or millimeter wave reflection intensity) differing from detection target information 141 and 142 that is registered in the detection target information database 112. As a result, it is possible to use detection results from a plurality of different types of sensors to increase the detection rate. Alternatively, it is possible to reduce a misdetection rate by using an AND of detection results.

In detection for the forward boundary detection region 156, because there are cases where a detection target registered in the detection target information database 112 is far and thus cannot be detected, it is determined that an obstacle is present when an object other than that in detection target information 142 registered in the detection target information database 112 is detected.

In a case where it is determined in step 203 that an obstacle is present, it is necessary to cause the transport vehicle 102 to stop, and thus obstacle detection information 145 is created in step 204. Meanwhile, step 205 is advanced to in a case where it is determined that there is no obstacle.

In step 205, the obstacle detection information 145 for the obstacle monitoring area is transmitted to the transport vehicle 102.

The above is a description for operation by the obstacle detection system 103.

(Operation by Self Position Estimation System 101)

Figure 8:
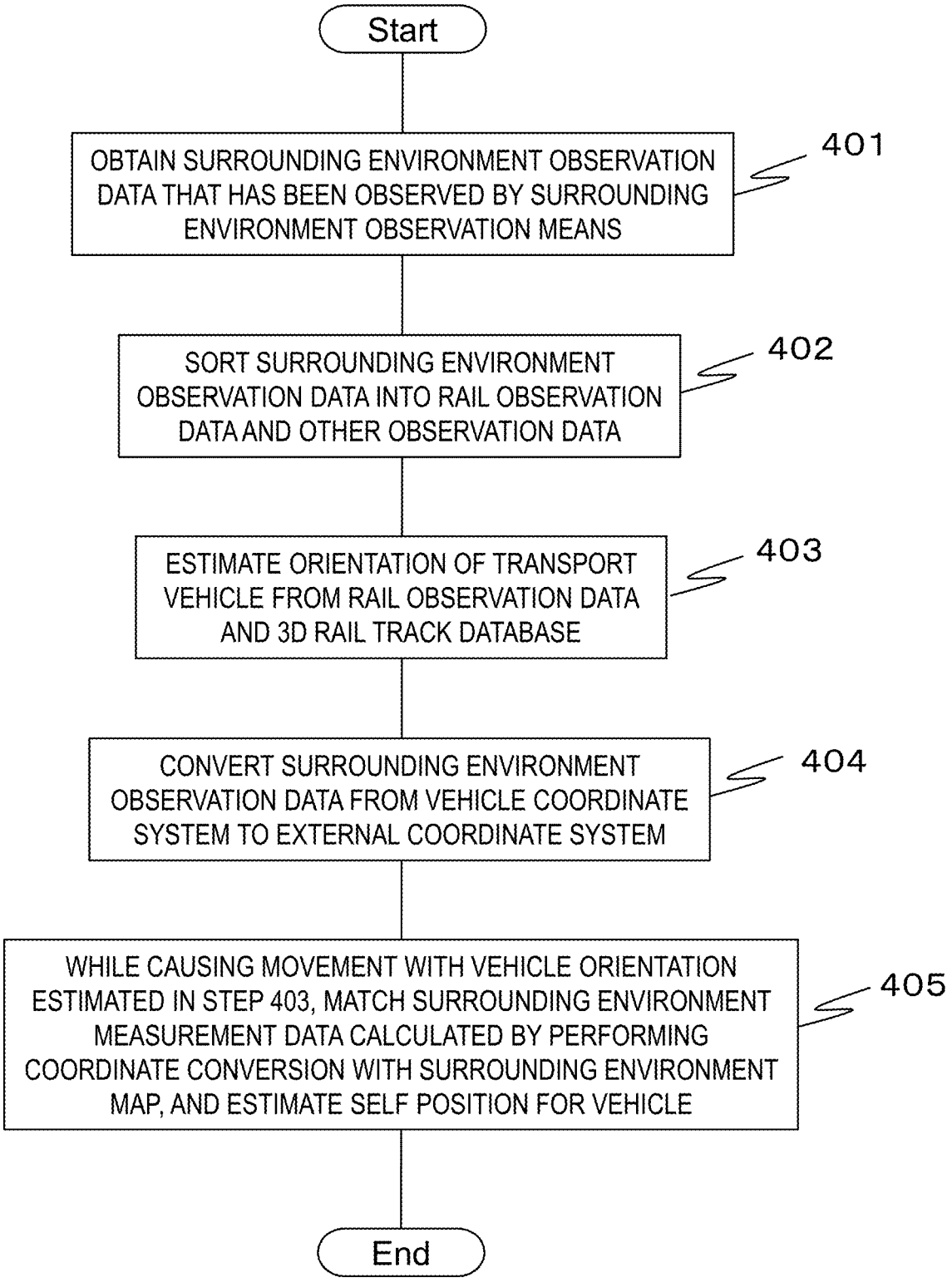
FIG. 8 is a flow chart that illustrates an example of a processing procedure for the self position estimation system.

Next, operation by the self position estimation system 101 is described. FIG. 8 is a flow chart that illustrates an example of a processing procedure executed by the self position estimation system 101.

In steps 401 through 405, a self position for a transport vehicle is estimated. This process is executed every observation cycle for the surrounding environment observation unit 107.

In step 401, surrounding environment observation data 130 observed by the surrounding environment observation unit 107 is obtained.

Figure 9:
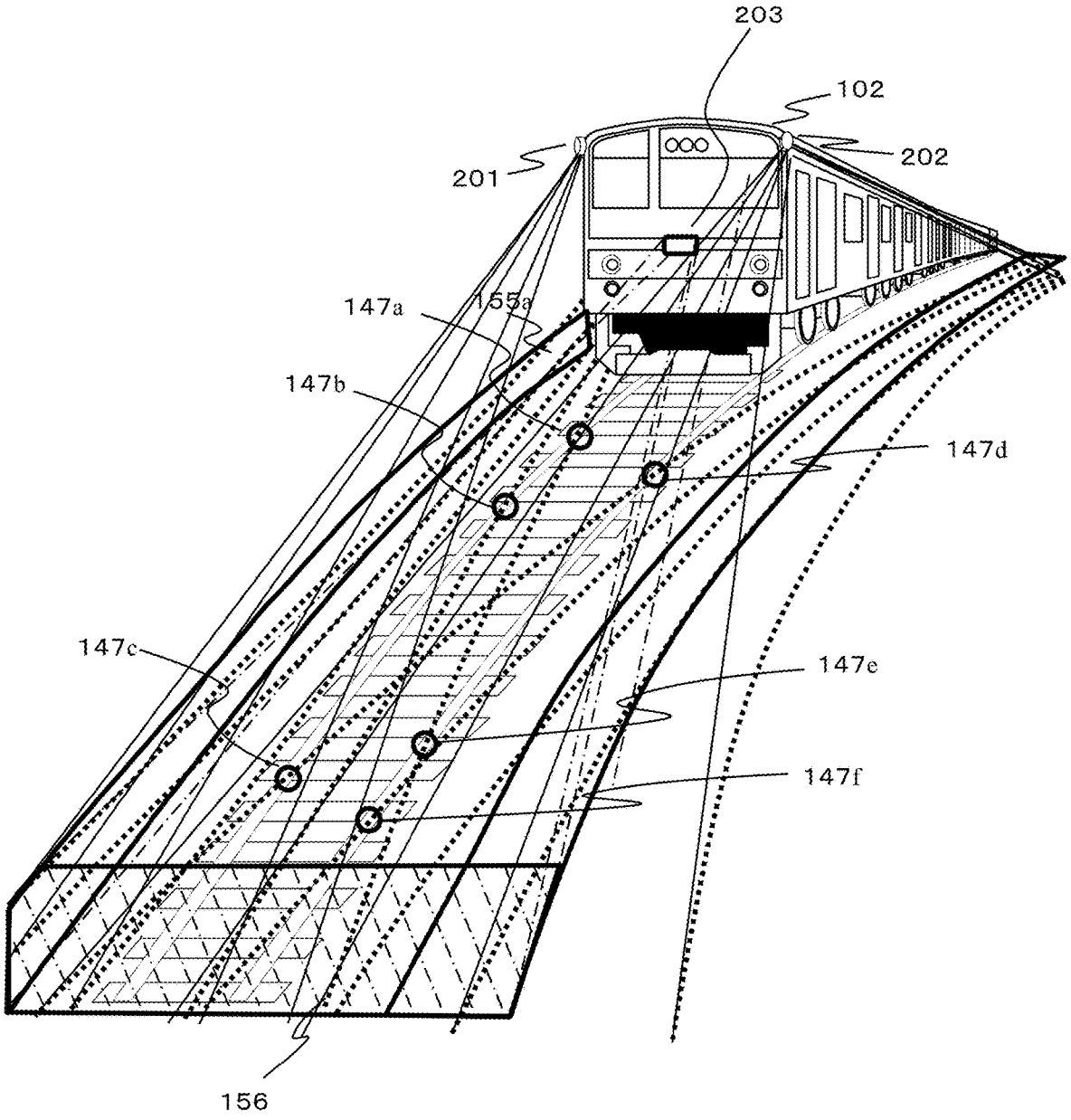
FIG. 9 is a view that illustrates an example of rail detection by the self position estimation system.

FIG. 9 is a view that illustrates an example of rail detection by a self position estimation system.

In step 402, rail observation data 147 in FIG. 9 is sorted out from among the surrounding environment observation data 130 obtained in step 401.

In addition to the shape or reflectance of a rail, the rail observation data 147 in FIG. 9 can be sorted out by making use of the fact that data detected as a rail forms one plane.

Figure 10:
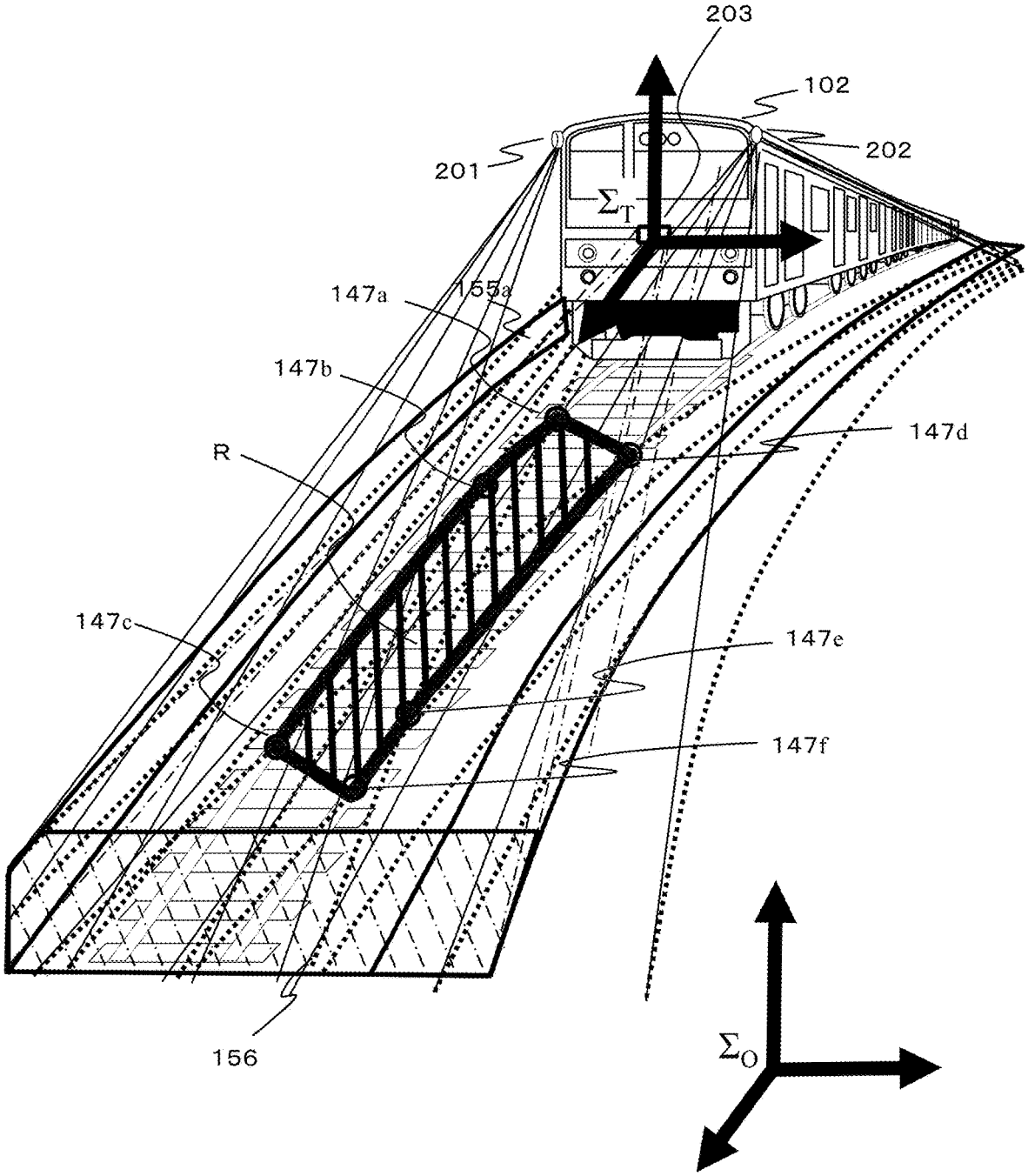
FIG. 10 is a view that illustrates an example of estimating a vehicle orientation by the self position estimation system.

FIG. 10 is a view that illustrates an example of estimating a vehicle orientation by the self position estimation system.

In step 403, the orientation of the transport vehicle 102 is estimated from a plane R formed by rail surfaces obtained from the rail observation data 147 as in FIG. 10, and rail position information 137 obtained from the three-dimensional rail track database 108. The orientation of the transport vehicle 102 means the inclination of the transport vehicle 102 with respect to an external coordinate system ΣO defined by the three-dimensional rail track database 108.

Here, three-dimensional point cloud data that passes through the left and right rails as well as the reflectances thereof are recorded in the three-dimensional rail track database 108.

In step 404, using the vehicle orientation 150 estimated in step 403, the surrounding environment observation data 130 is converted from a vehicle coordinate system $\Sigma_T$ fixed to the transport vehicle 102 to an external coordinate system $\Sigma_O$ in which the surrounding environment map database 120 and the three-dimensional rail track database 108 are defined to thereby achieve the surrounding environment measurement data 151.

In step 405, the self position of the vehicle is estimated by matching the surrounding environment measurement data 151 calculated by the coordinate conversion in step 404 against the surrounding environment map data 153 recorded in the surrounding environment map database 120 while causing movement on the track recorded in the three-dimensional rail track database 108 and while maintaining the vehicle orientation 149 estimated in step 403.

Figure 11:
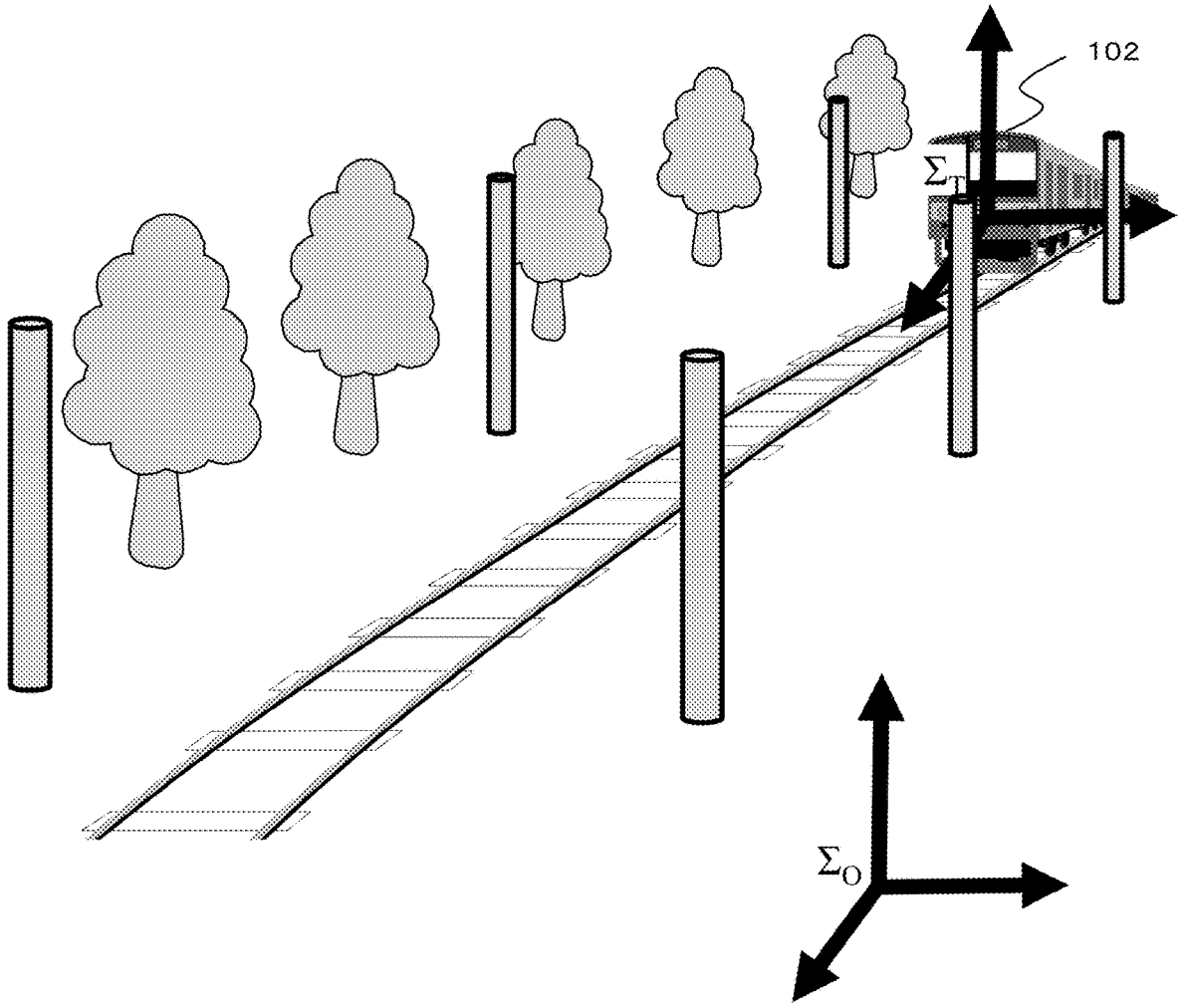
FIG. 11 is a view that illustrates an example of a surrounding environment through which a transport vehicle travels.
Figure 12:
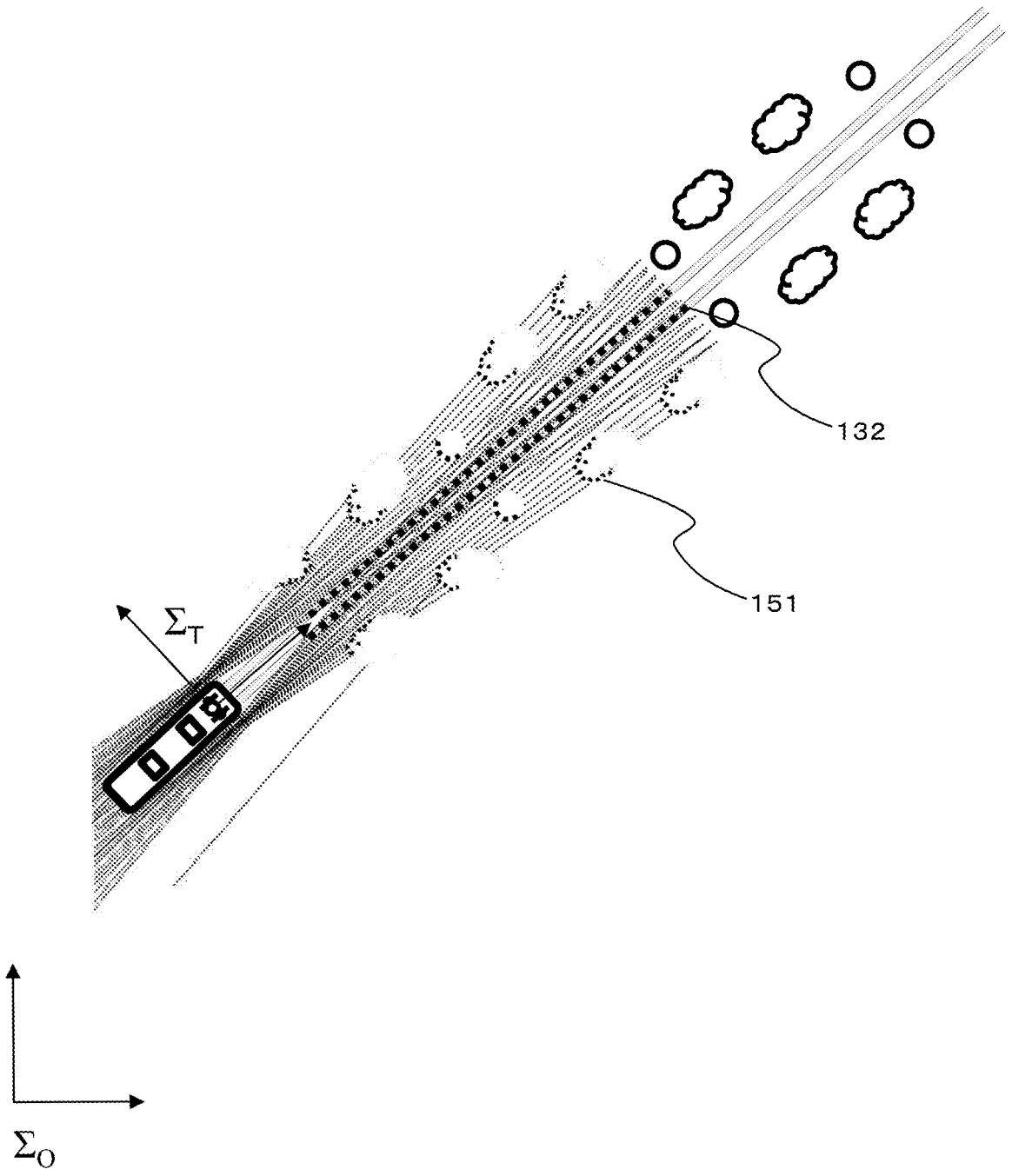
FIG. 12 is a view that illustrates an example of surrounding environment measurement data.

FIG. 11 is a view that illustrates an example of a surrounding environment through which a transport vehicle travels, and FIG. 12 is a view that illustrates an example of surrounding environment measurement data.

For example, when the surrounding environment in FIG. 11 is observed by a multilayer type LIDAR device, in step 404, it is possible to obtain point cloud data 151 which is defined in the external coordinate system $\Sigma_0$ as in FIG. 12.

Figure 13:
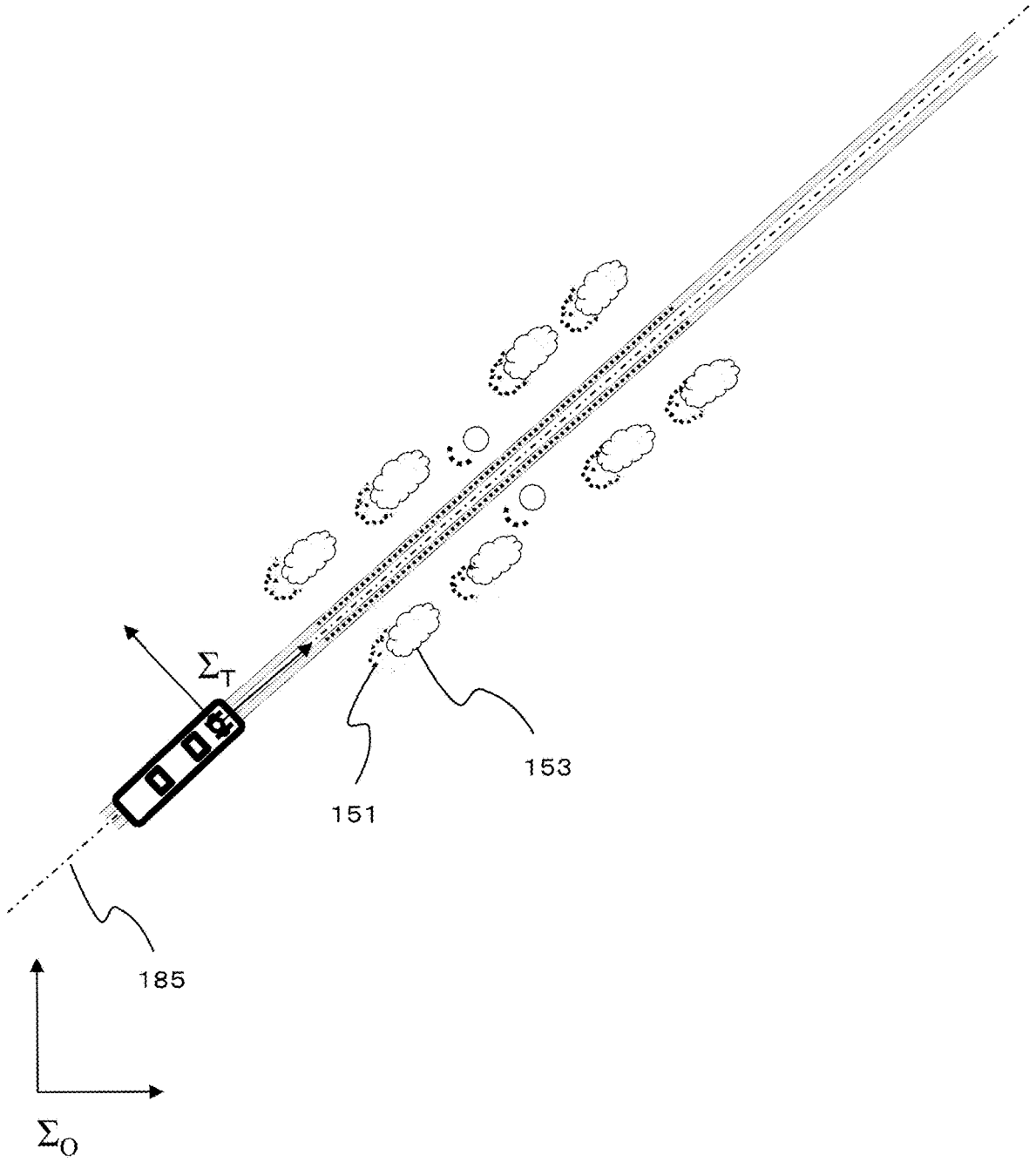
FIG. 13 is a view that illustrates an example of matching surrounding environment measurement data against surrounding environment map data (before matching).
Figure 14:
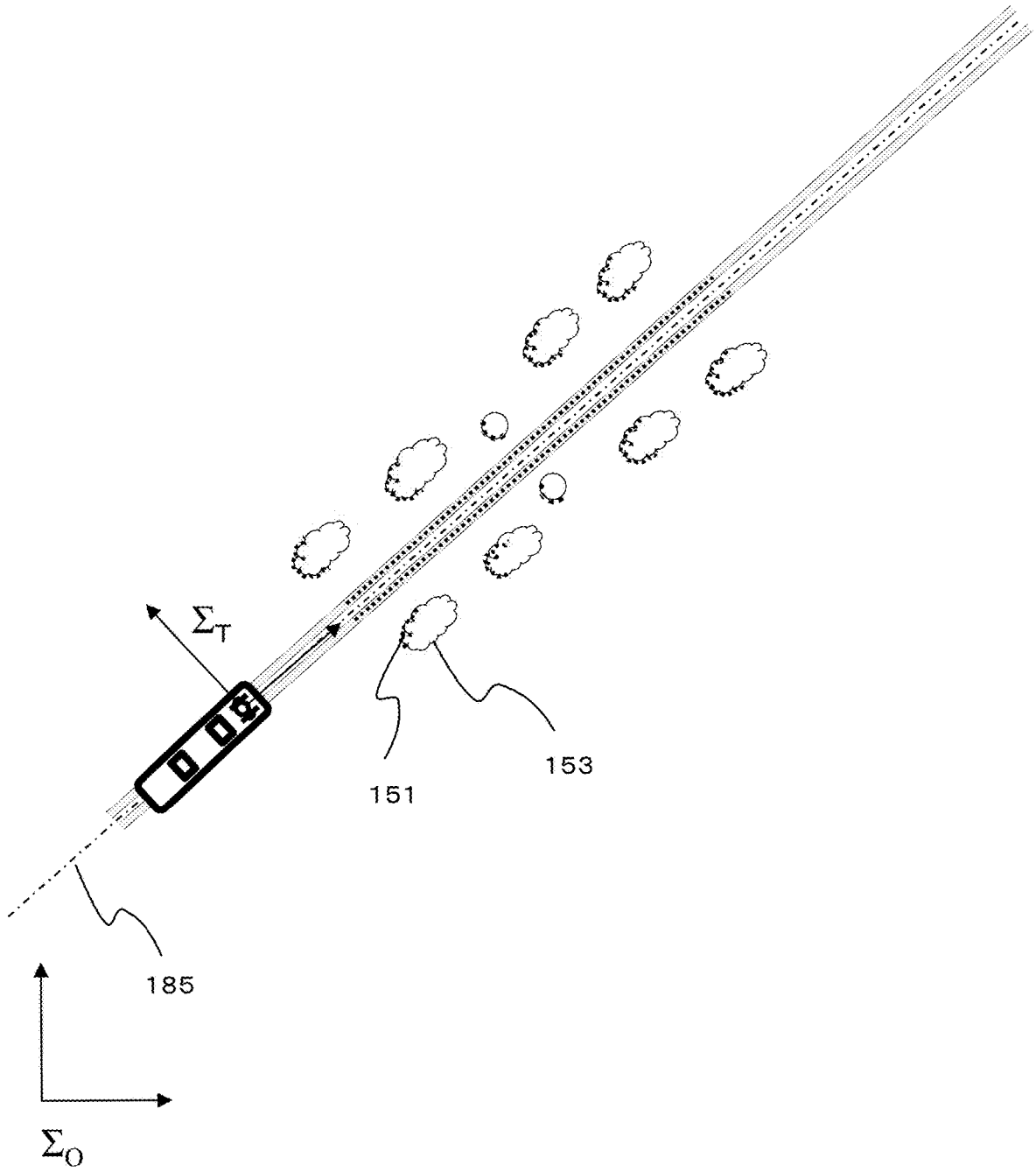
FIG. 14 is a view that illustrates an example of matching surrounding environment measurement data against surrounding environment map data (after matching).
Figure 15:
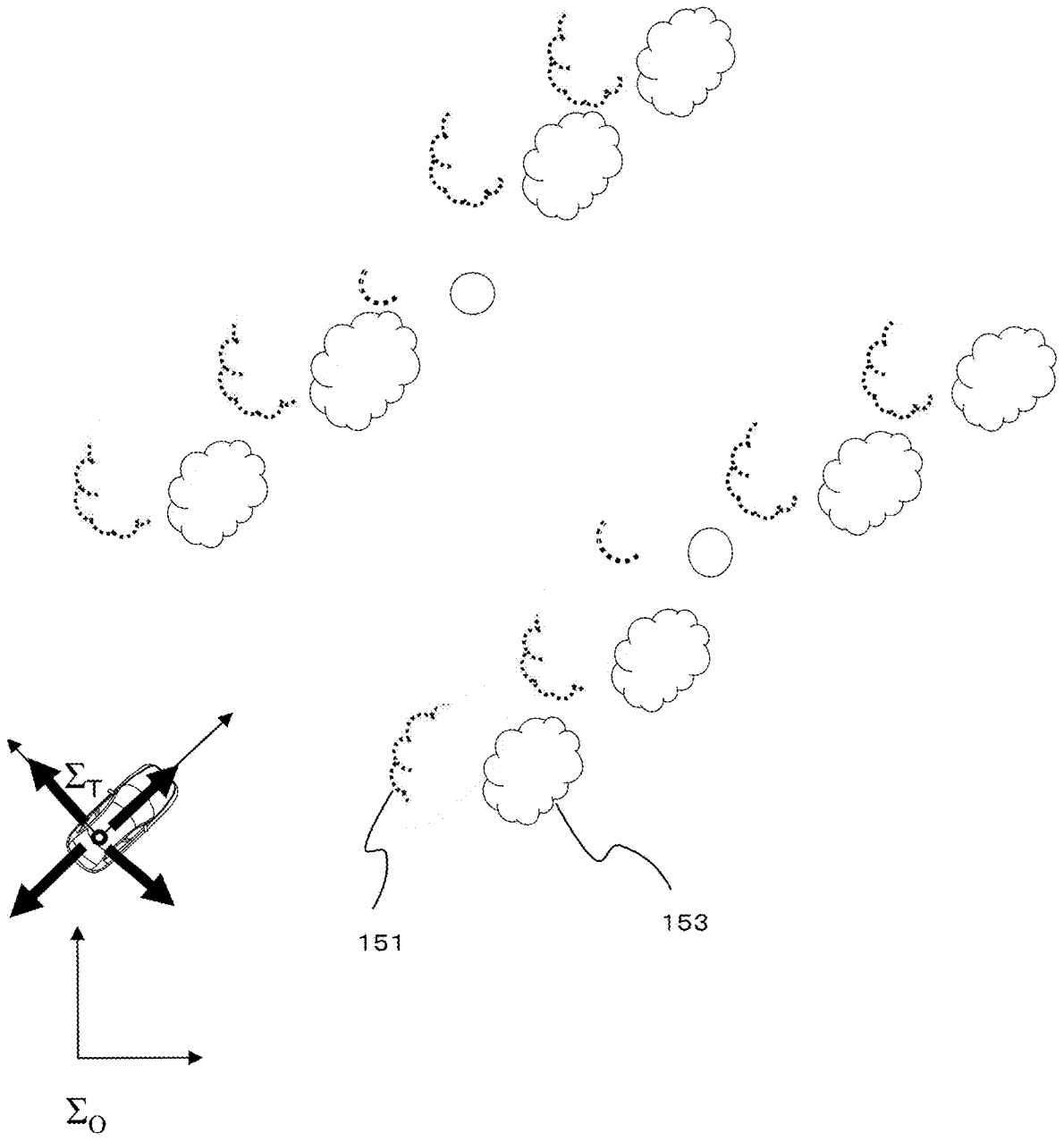
FIG. 15 is a view that illustrates an example of matching surrounding environment measurement data for an automobile against surrounding environment map data (before matching).
Figure 16:
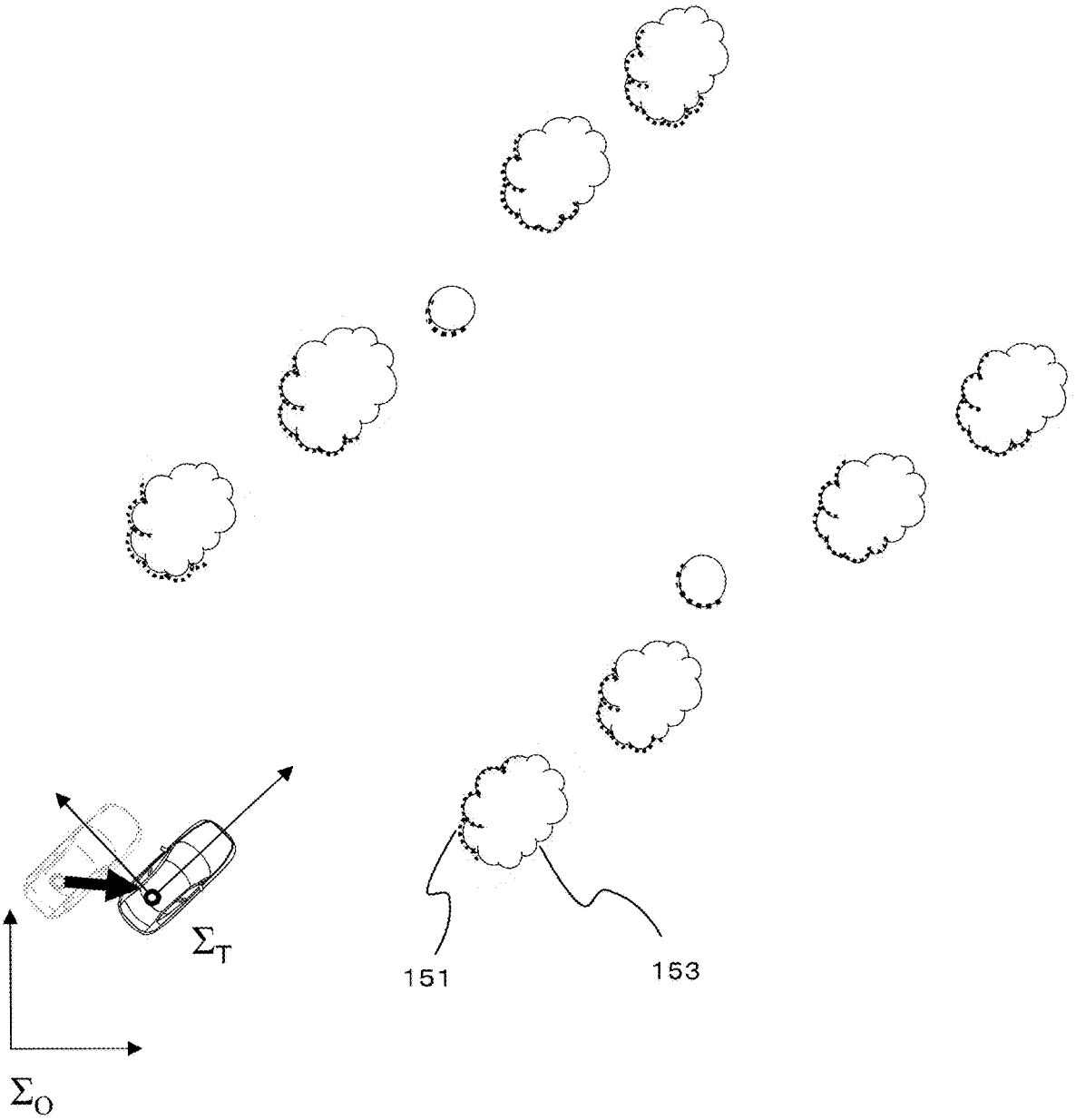
FIG. 16 is a view that illustrates an example of matching surrounding environment measurement data for an automobile against surrounding environment map data (after matching).

FIG. 13 and FIG. 14 are views that illustrate an example of matching surrounding environment measurement data against surrounding environment map data, and FIG. 15 and FIG. 16 are views that illustrate an example of matching surrounding environment measurement data against surrounding environment map data for an automobile.

In a case where there is no travel along a specific track as with an automobile, as in FIG. 15 and FIG. 16, it is necessary to obtain correlation between the surrounding environment measurement data 151 and the surrounding environment map data 153 while causing movement in an optionally-defined direction, and obtain a position where the value of this correlation is highest (FIG. 16) as the self position. In contrast, because there is a transport vehicle travels on a track here, it may be that a correlation is taken between the surrounding environment measurement data 151 and the surrounding environment map data 153 while causing movement on a rail track 185 in FIG. 13, and a position (FIG. 14) where the value of this correlation is highest is obtained as a self position. In addition, at this point, the estimated self position is always on the track, and it is possible to prevent the estimated self position from deviating from the track as with the impact of a multipath in a case of using GNSS.

The above is a description for operation by the self position estimation system 101.

(Operation by Trackside Equipment Shape Measurement System 104)

Figure 17:
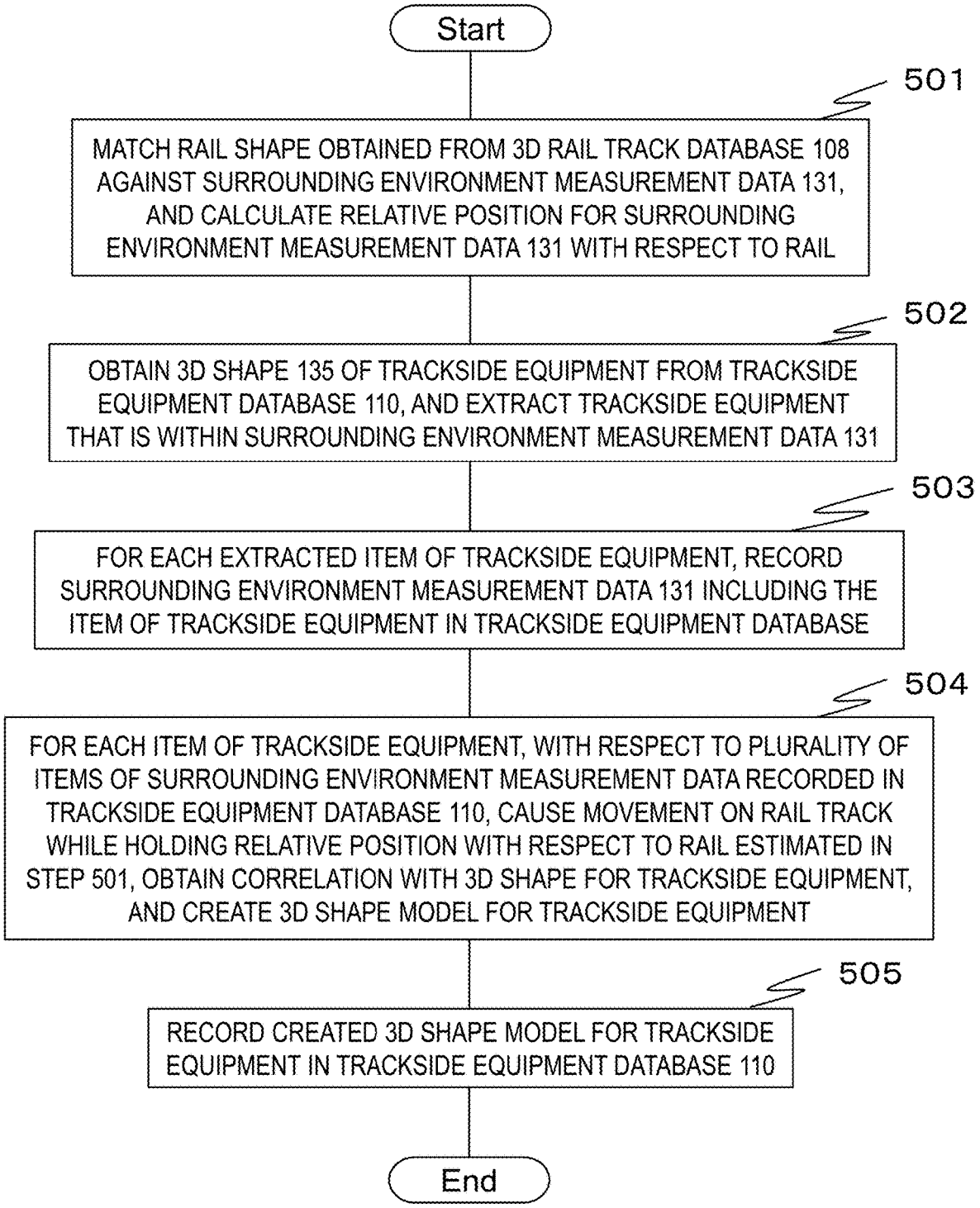
FIG. 17 is a flow chart that illustrates an example of a processing procedure that is executed by the trackside equipment shape measurement system.
Figure 18:
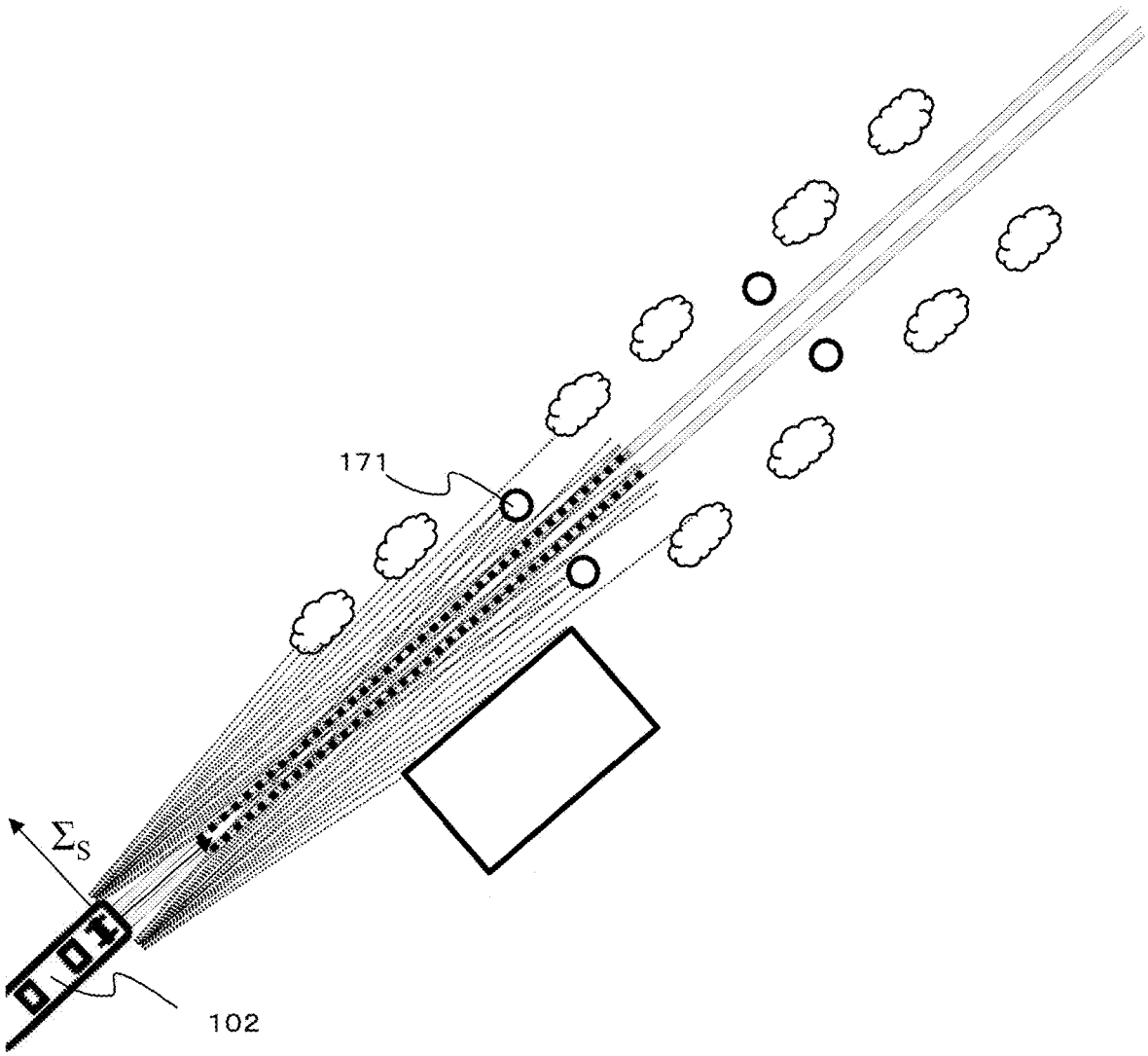
FIG. 18 is a view that illustrates an example (1) of surrounding environment observation that obtains surrounding environment measurement data used by the trackside equipment shape measurement system.
Figure 19:
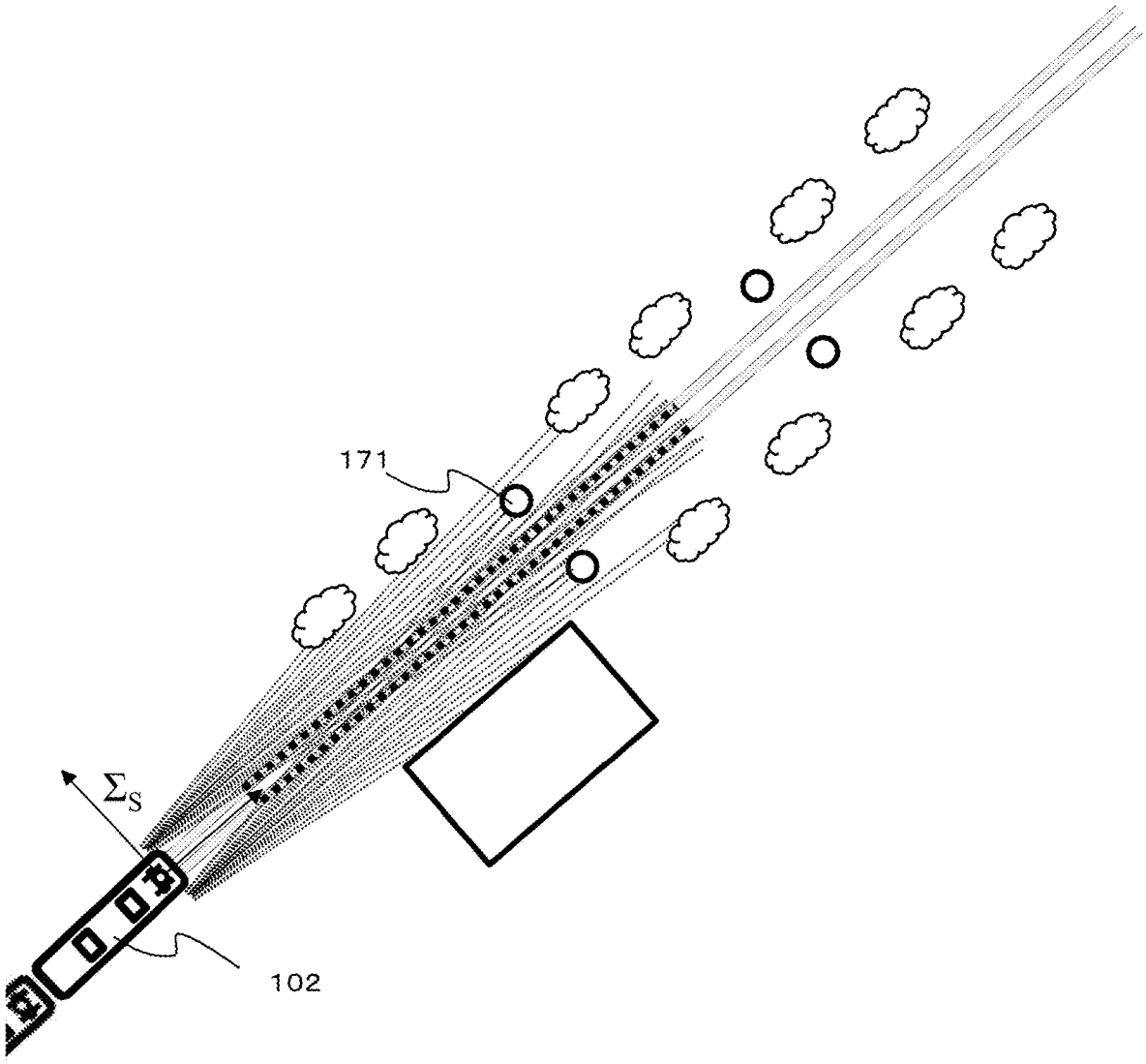
FIG. 19 is a view that illustrates an example (2) of surrounding environment observation that obtains surrounding environment measurement data used by the trackside equipment shape measurement system.
Figure 20:
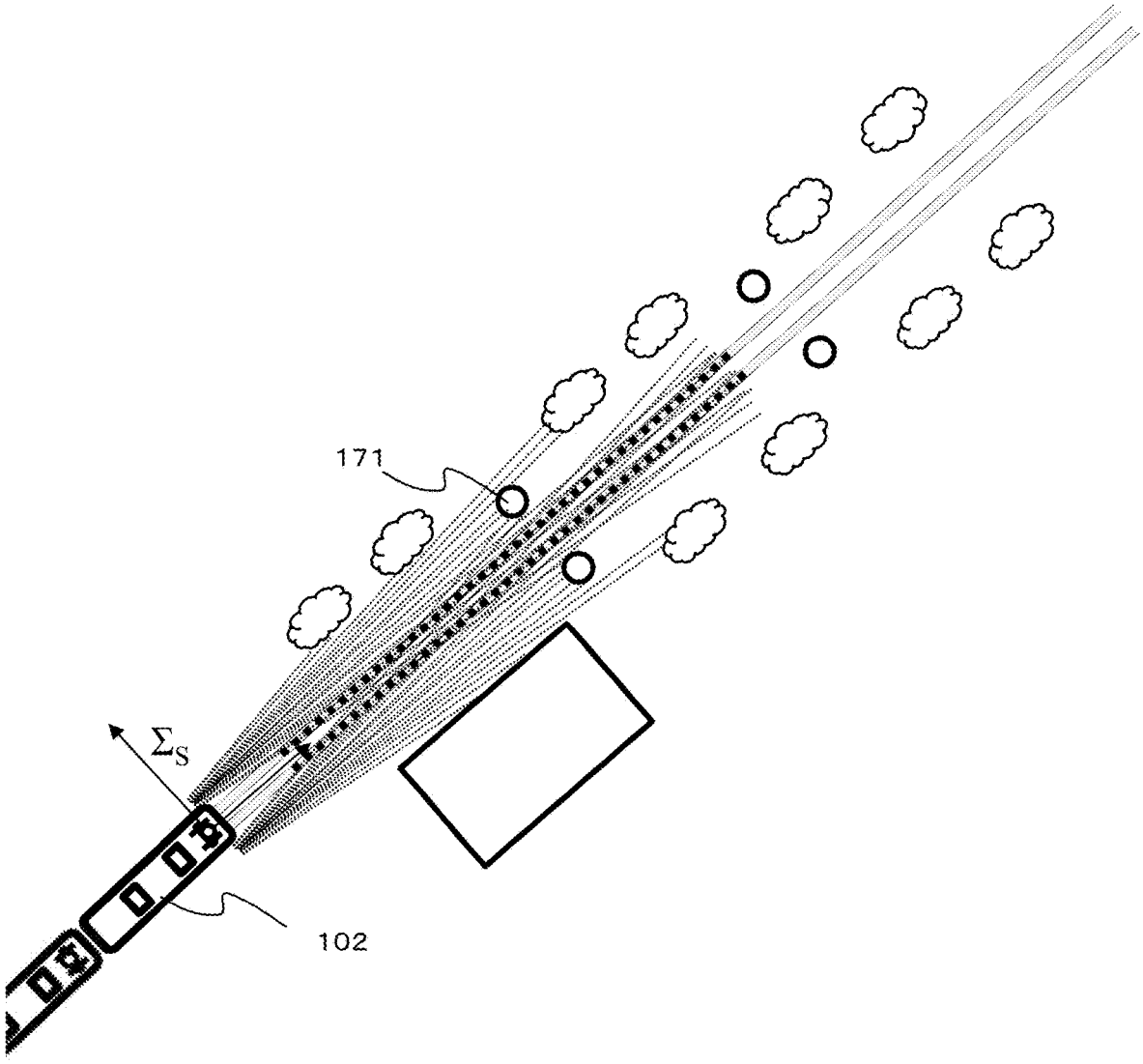
FIG. 20 is a view that illustrates an example (3) of surrounding environment observation that obtains surrounding environment measurement data used by the trackside equipment shape measurement system.
Figure 21:
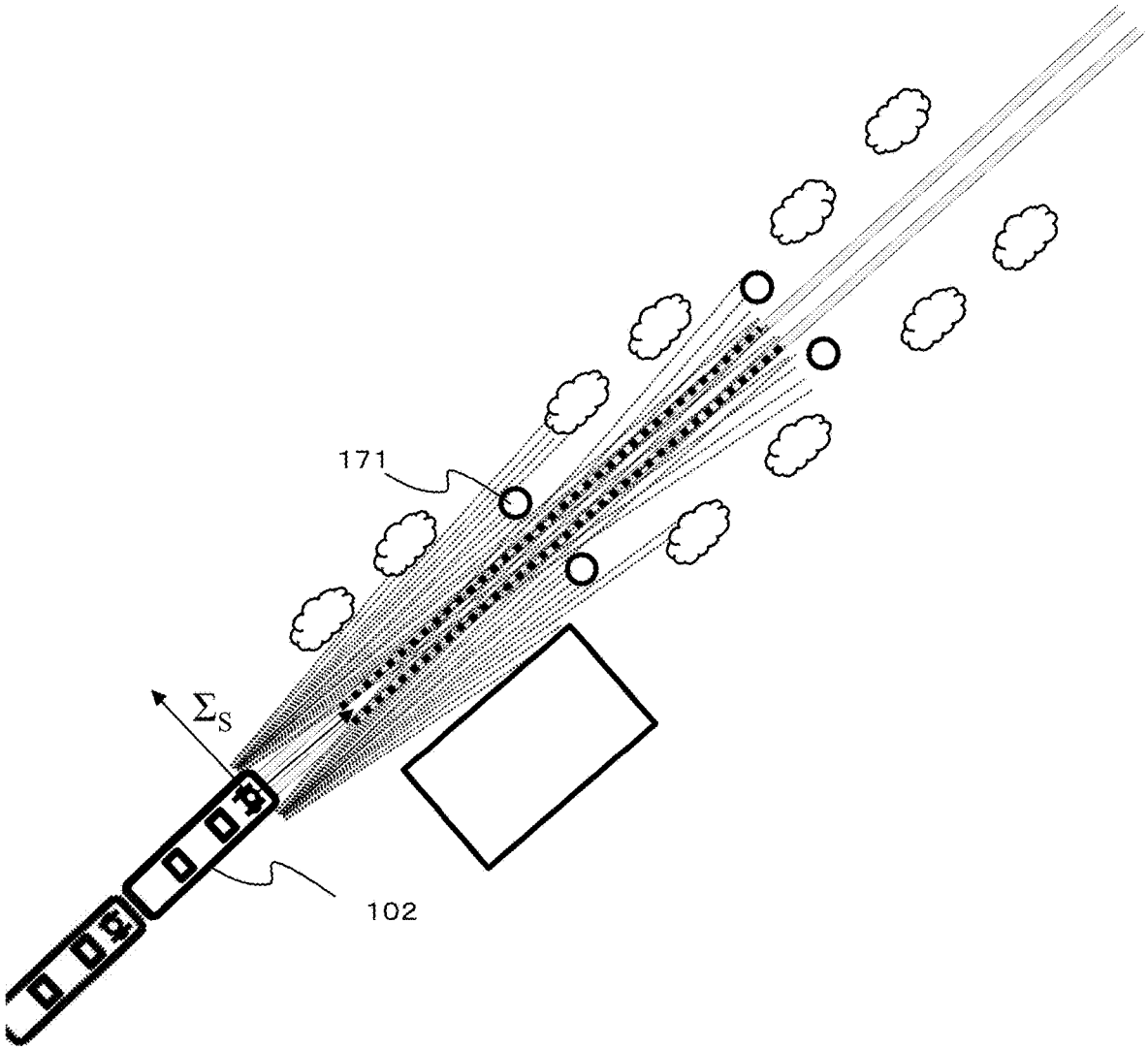
FIG. 21 is a view that illustrates an example (4) of surrounding environment observation that obtains surrounding environment measurement data used by the trackside equipment shape measurement system.
Figure 22:
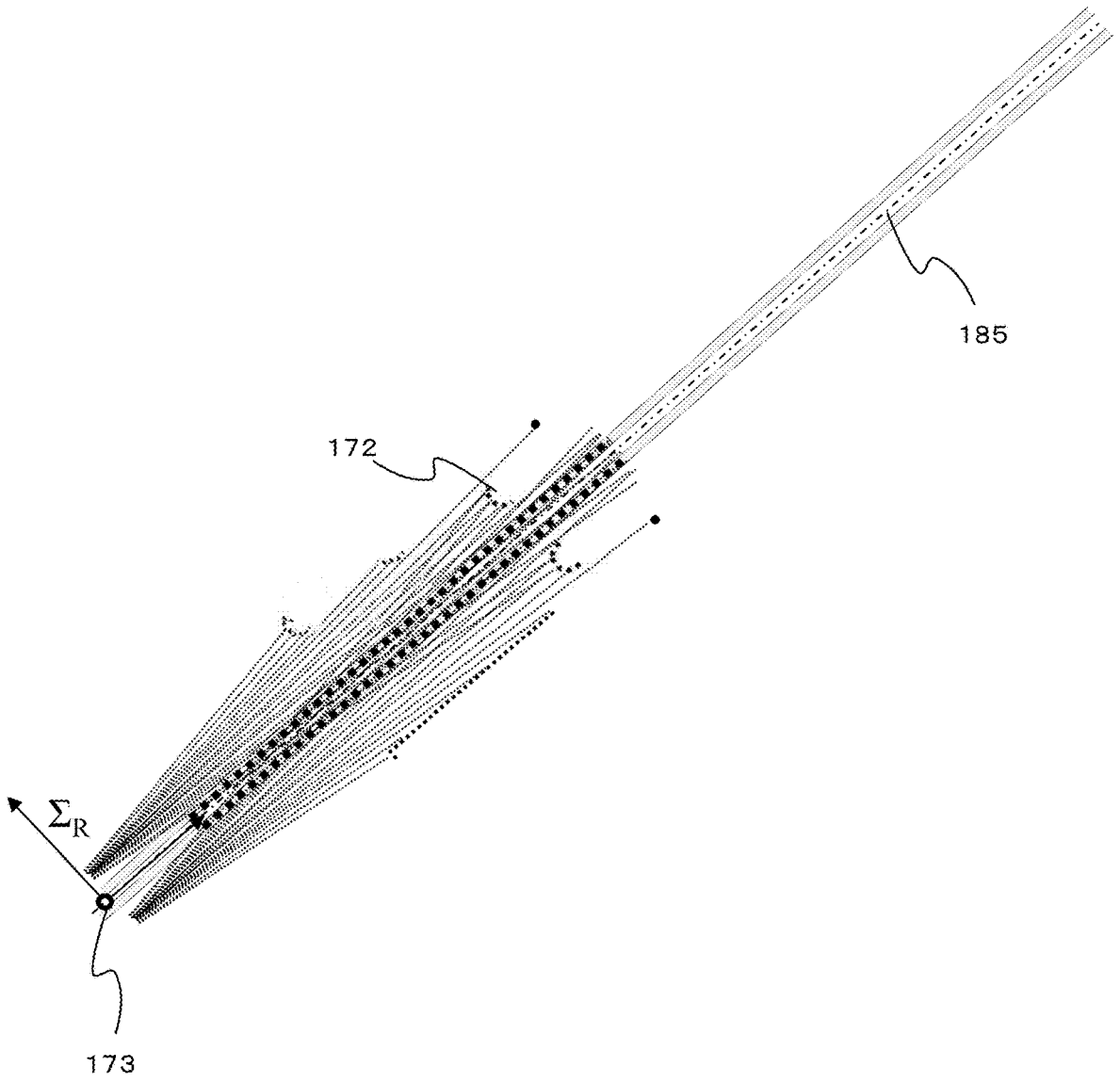
FIG. 22 is a view that illustrates an example (1) of surrounding environment measurement data used by the trackside equipment shape measurement system.
Figure 23:
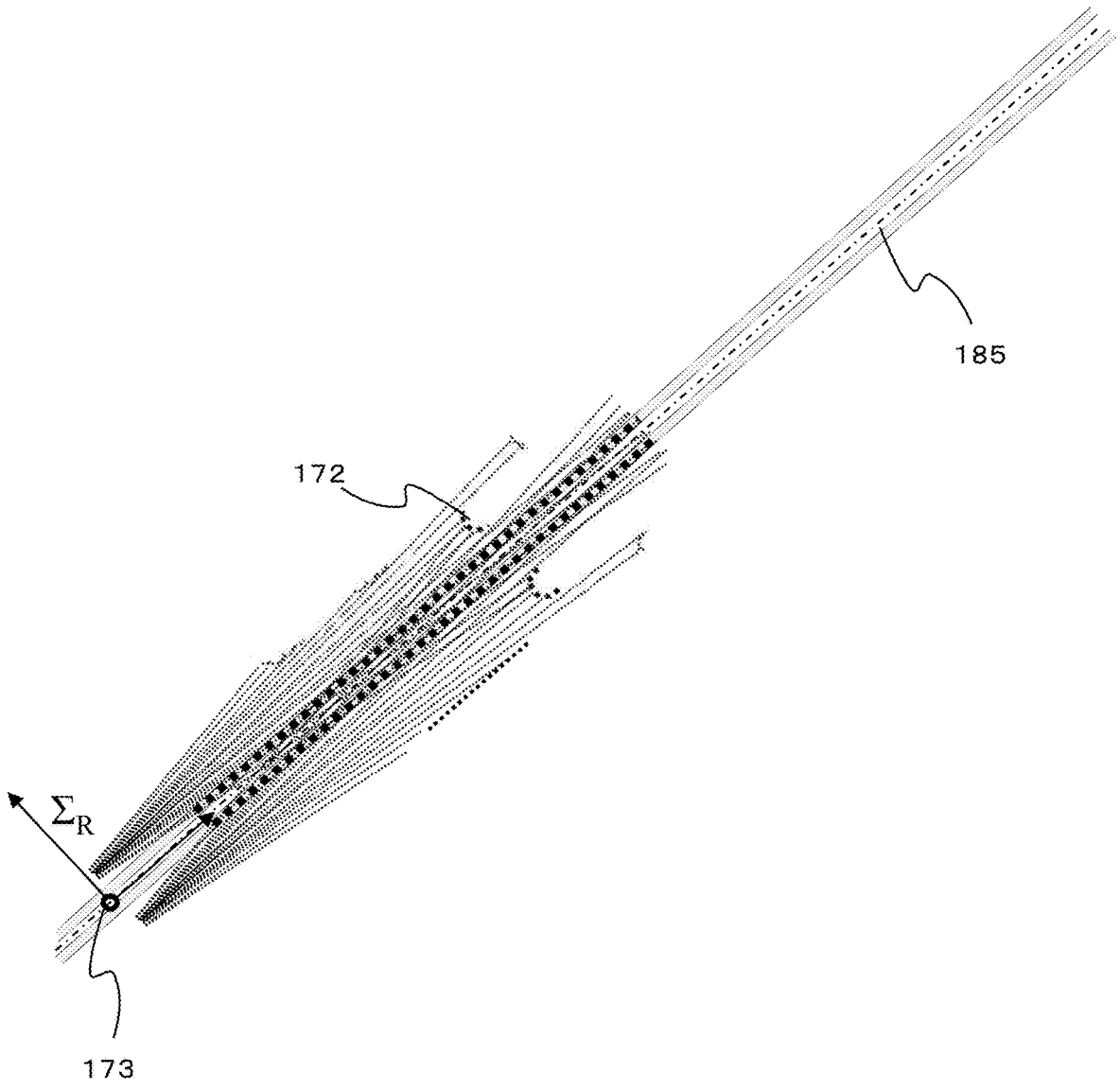
FIG. 23 is a view that illustrates an example (2) of surrounding environment measurement data used by the trackside equipment shape measurement system.
Figure 24:
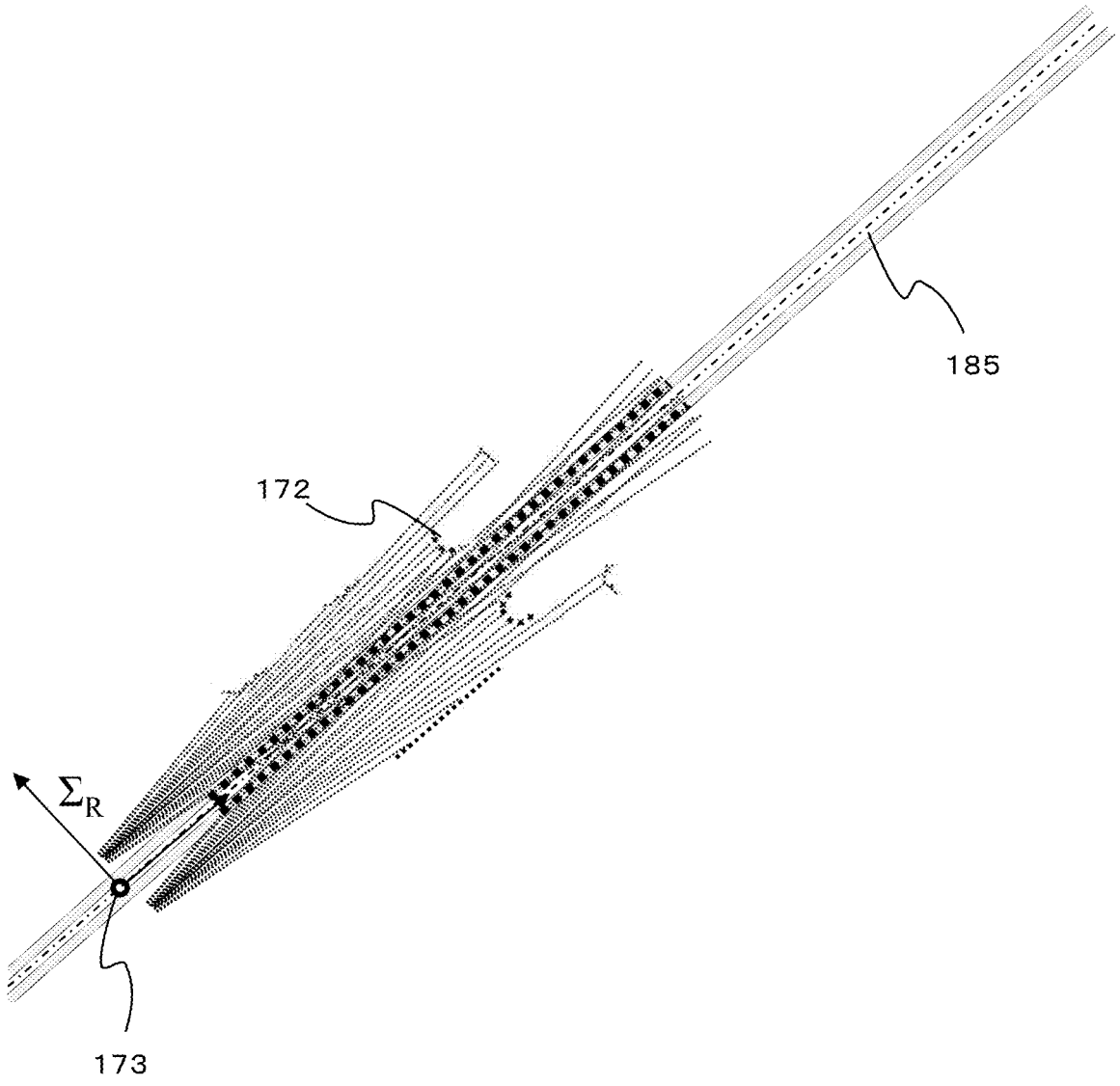
FIG. 24 is a view that illustrates an example (3) of surrounding environment measurement data used by the trackside equipment shape measurement system.
Figure 25:
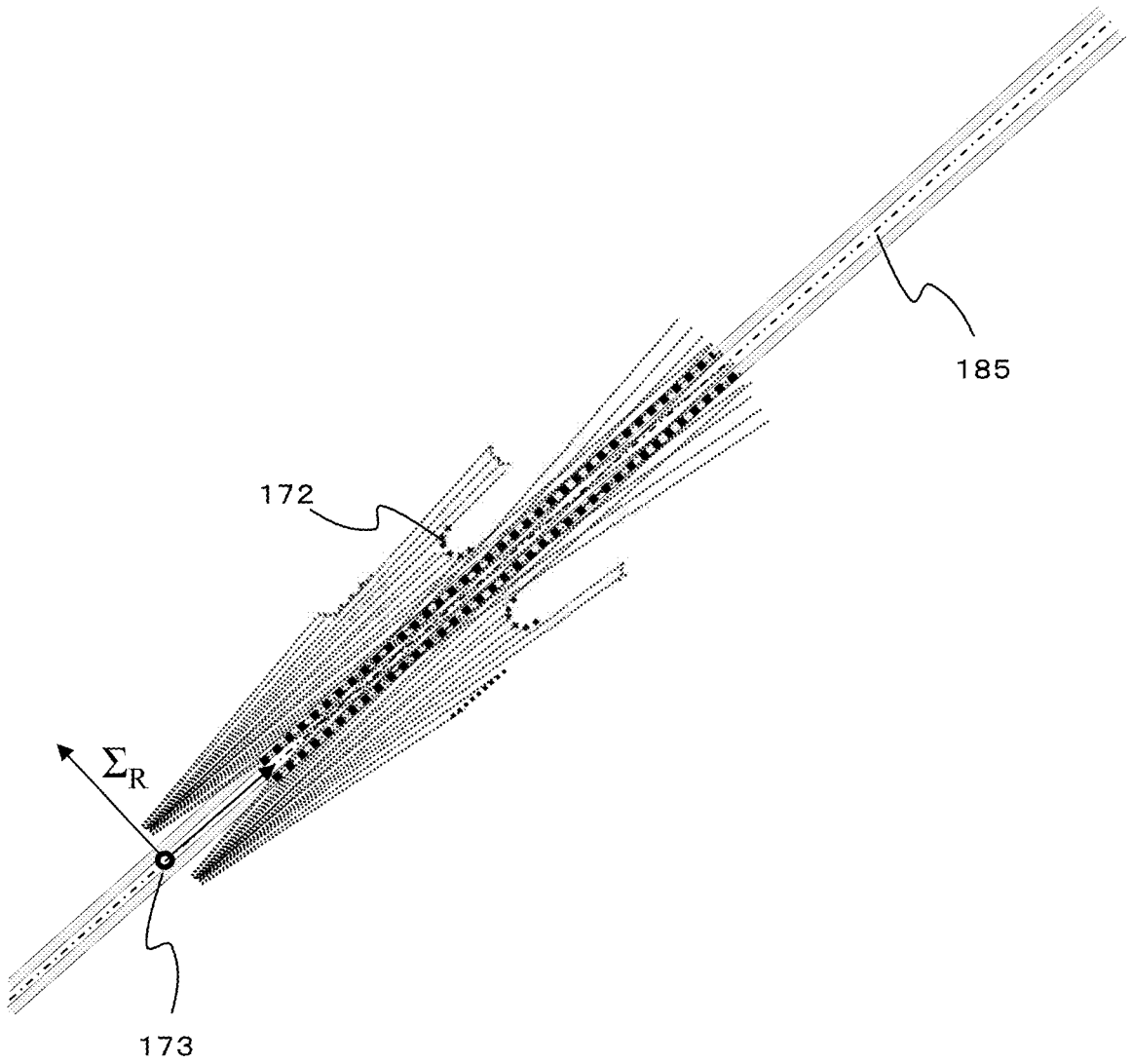
FIG. 25 is a view that illustrates an example (4) of surrounding environment measurement data used by the trackside equipment shape measurement system.

Next, operation by the trackside equipment shape measurement system 104 is described. FIG. 17 is a flow chart that illustrates an example of a processing procedure that is executed by the trackside equipment shape measurement system 104.

In steps 501 through 505, the shape of an item of trackside equipment is measured. This process is executed every observation cycle for the surrounding environment observation unit 107.

FIG. 18 through FIG. 21 are views that illustrate examples of surrounding environment observation for obtaining surrounding environment measurement data that is used in a trackside equipment shape measurement system, and FIG. 22 through FIG. 25 are views that illustrate examples of surrounding environment measurement data that is used in a trackside equipment shape measurement system.

In step 501, the surrounding environment measurement data 131 resulting from conversion to the external coordinate system is obtained from the self position estimation system 101 and matching with the rail shape model 134 obtained from the three-dimensional rail track database 108 is performed with respect to the surrounding environment measurement data 131 to thereby calculate a relative position with respect to the rail track 185 for the surrounding environment measurement data 131. Here, the relative position with respect to the rail track 185 is defined in a relative position coordinate system which has an origin 173 on the rail track 185 or in a distance/orientation with respect to the rails. For example, the surrounding environment measurement data 131 obtained at positions in FIG. 18 through FIG. 21 can be defined by a coordinate system $\Sigma_R$ which has the origin 173 on the rail track 185 as in FIG. 22 through FIG. 25.

In step 502, trackside equipment 171 is detected from the surrounding environment measurement data 131 on the basis of trackside equipment information (position/orientation, three-dimensional shape, color, reflectance) 135 obtained from the trackside equipment database 110. Note that the position/orientation of trackside equipment does not necessarily need to be a position/orientation in the external coordinate system, and may be a distance or orientation with respect to a rail.

Figure 26:
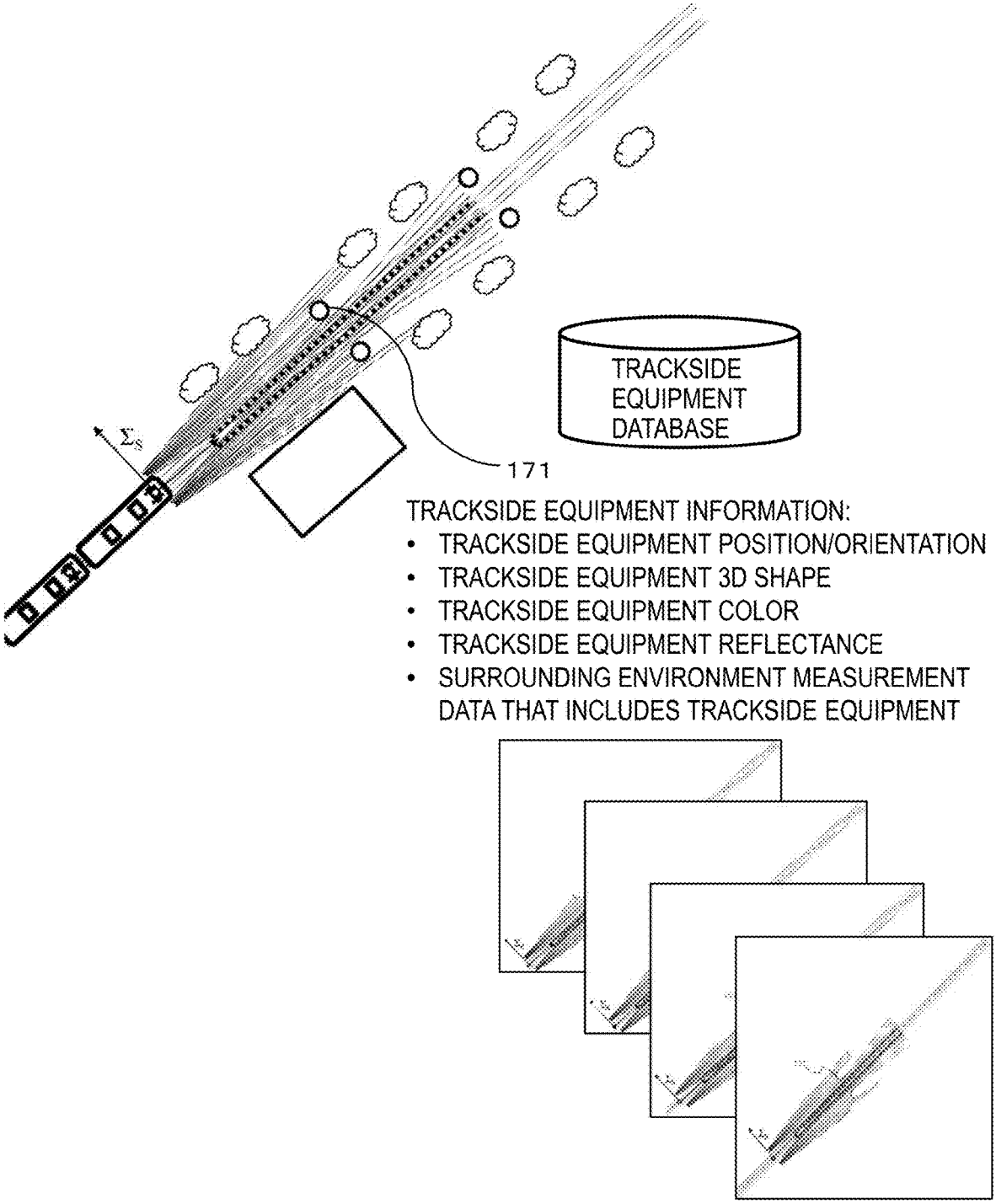
FIG. 26 is a view that illustrates an example of a trackside equipment database used by the trackside equipment shape measurement system.

FIG. 26 is a view that illustrates an example of a trackside equipment database used by the trackside equipment shape measurement system.

In step 503, for each item of detected trackside equipment 171, the surrounding environment measurement data 131 in which the item of trackside equipment 171 has been detected is recorded to the trackside equipment database 110 as in FIG. 26.

Figure 27:
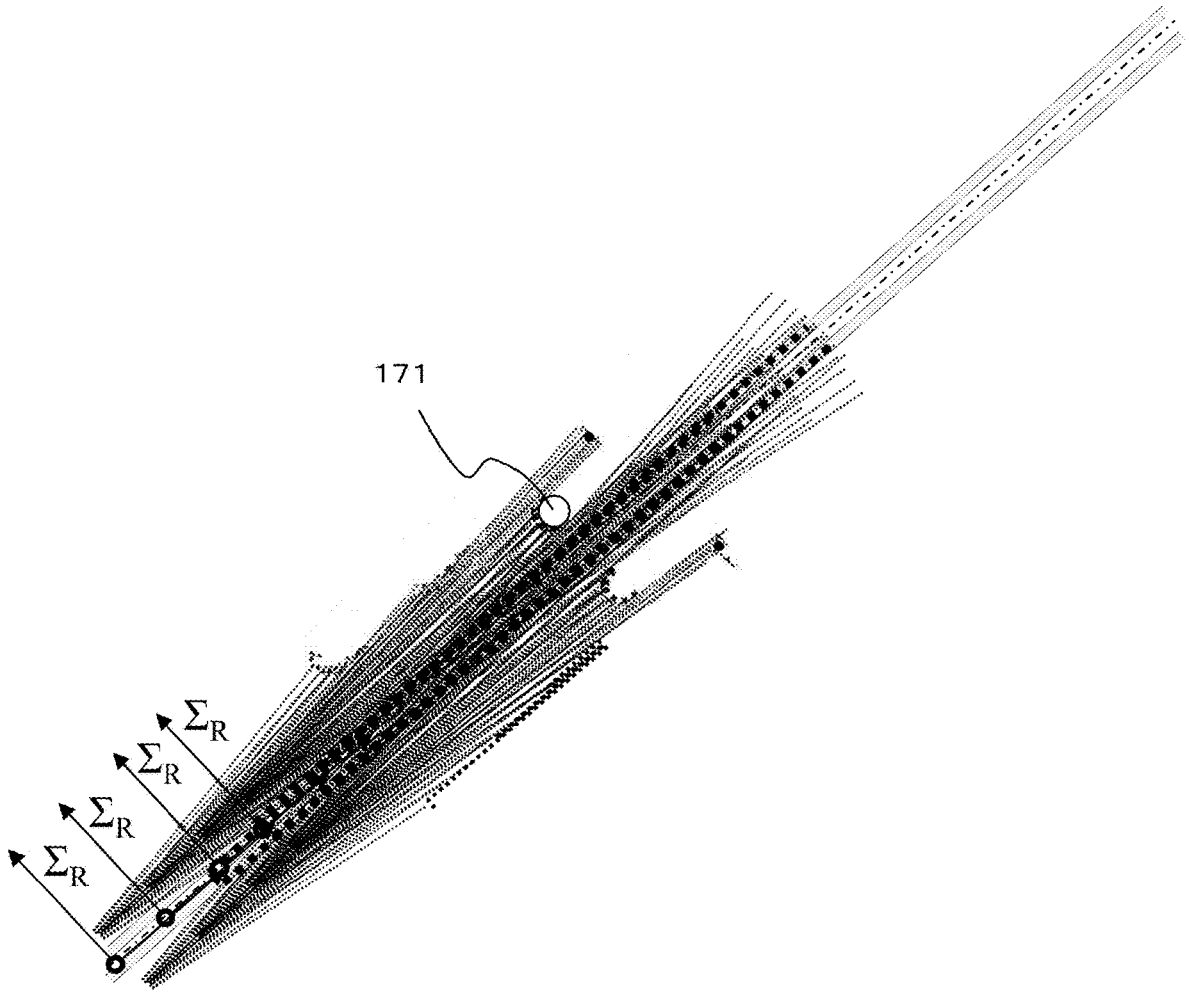
FIG. 27 is a view that illustrates an example of matching surrounding environment measurement data against trackside equipment in the trackside equipment shape measurement system.

FIG. 27 is a view that illustrates an example of matching surrounding environment measurement data against trackside equipment in the trackside equipment shape measurement system.

In step 504, a plurality of items of surrounding environment measurement data 131 within the trackside equipment database 110 that have been recorded for respective items of trackside equipment 171 are matched against a three-dimensional shape model for the trackside equipment 171 while causing movement on the rail track 185 and while maintaining the relative position with respect to the rails that have been estimated in step 501, and a three-dimensional shape for the trackside equipment 171 is created as in FIG. 27. Here, it is possible to use an ICP algorithm to perform matching among items of surrounding environment measurement data 131. At this point, greater weighting is applied to measurement data 172 for the trackside equipment 171 to thereby improve the accuracy of the three-dimensional shape model for the trackside equipment 171.

In other words, the trackside equipment shape measurement system obtains a three-dimensional shape for trackside equipment by overlapping, on the basis of a rail track, a plurality of items of surrounding environment measurement data, which include trackside equipment obtained at a plurality of positions on the track. More specifically, the trackside equipment shape measurement system obtains the three-dimensional shape of trackside equipment by overlapping a plurality of items of surrounding environment observation data, which include the trackside equipment, on the basis of a result of matching rail measurement data included in surrounding environment measurement data against a shape model for the rail, and a result of matching trackside equipment measurement data included in the surrounding environment measurement data against the shape of the trackside equipment.

Figure 28:
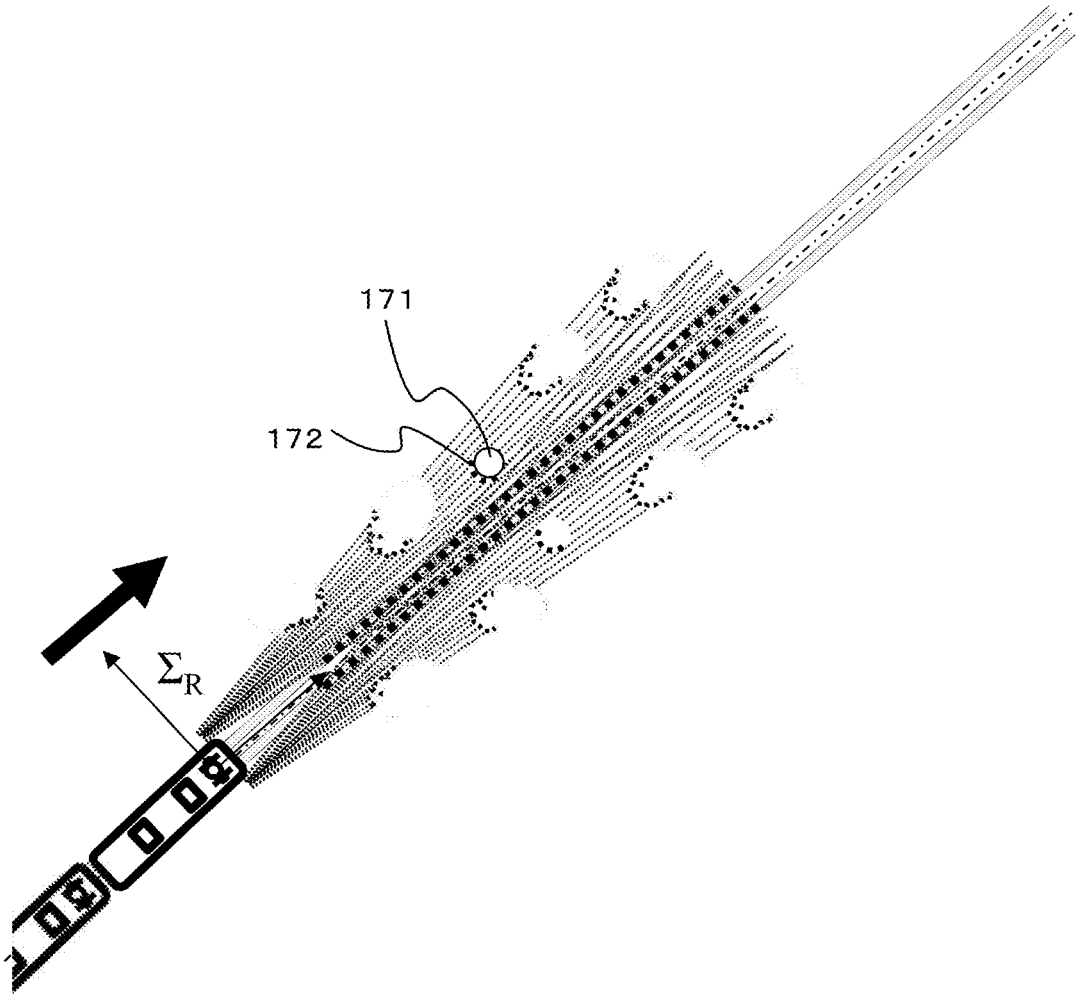
FIG. 28 is a view that illustrates an example of surrounding environment measurement data observed by a sensor installed at the front.
Figure 29:
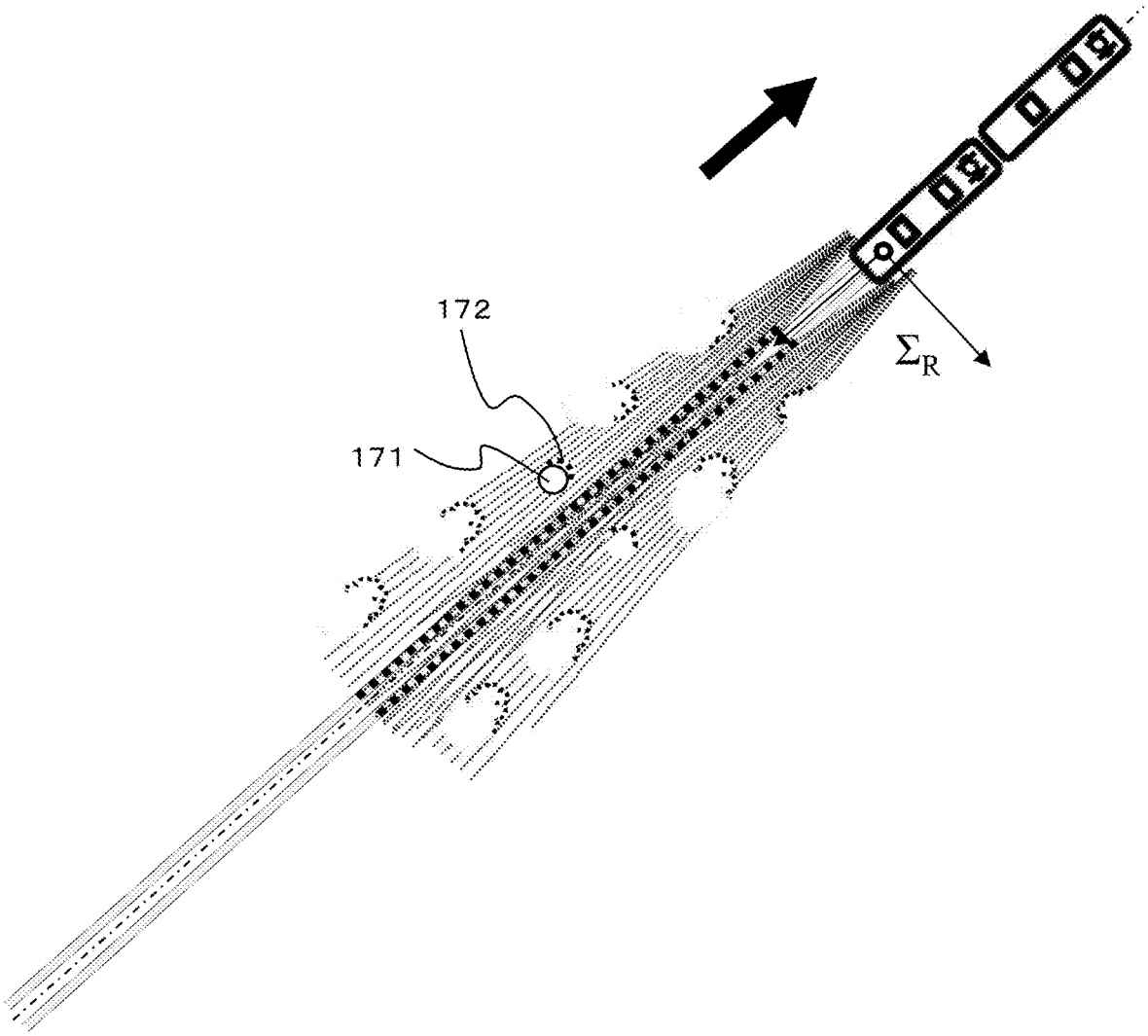
FIG. 29 is a view that illustrates an example of surrounding environment measurement data observed by a sensor installed at the rear.
Figure 30:
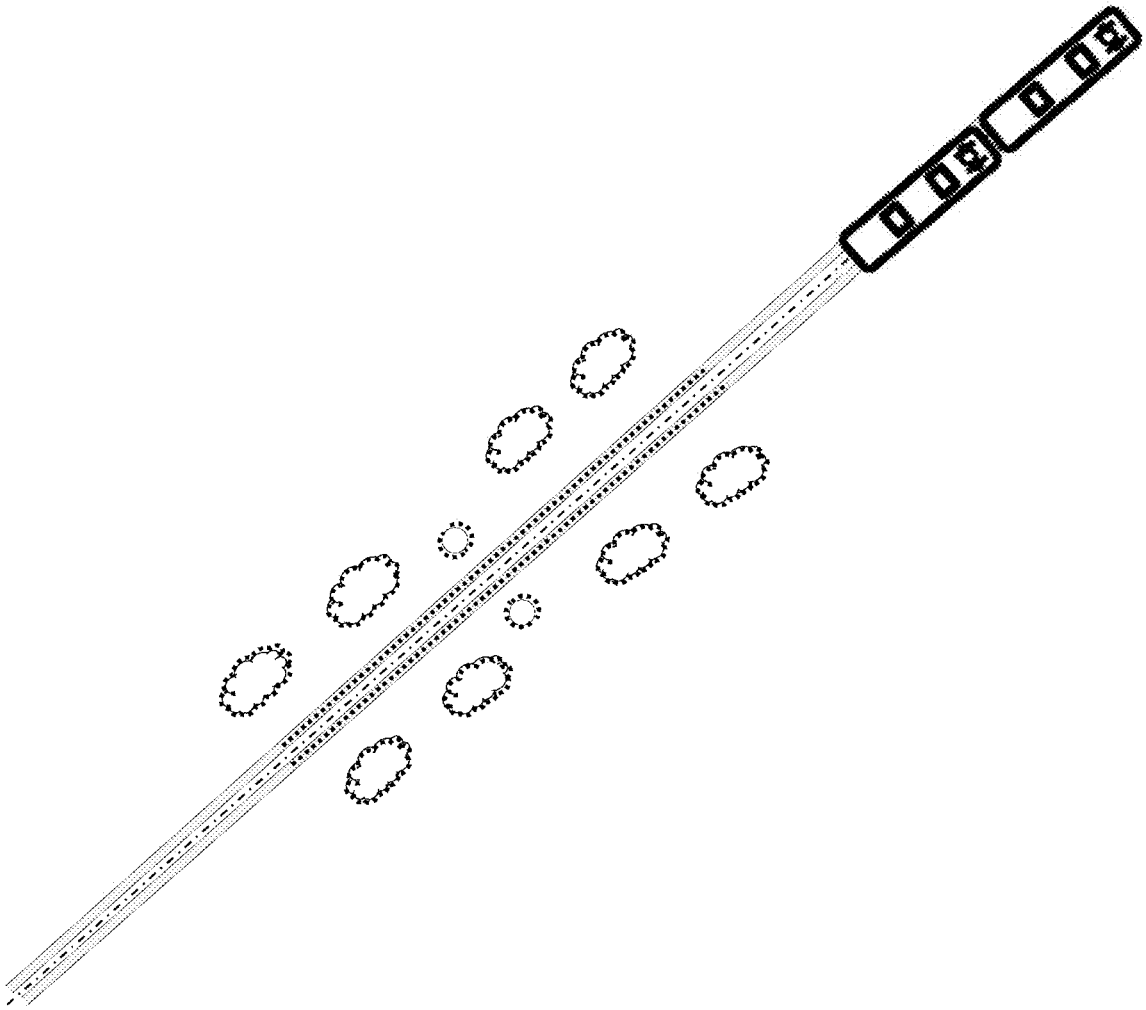
FIG. 30 is a view that illustrates an example of measuring a trackside equipment shape using surrounding environment measurement data observed by a sensor installed at the front and surrounding environment measurement data observed by a sensor installed at the rear.

FIG. 28 is a view that illustrates an example of surrounding environment measurement data observed by a sensor installed at the front, FIG. 29 is a view that illustrates an example of surrounding environment measurement data observed by a sensor installed at the rear, and FIG. 30 is a view that illustrates an example of measurement of trackside equipment shapes in accordance with the surrounding environment measurement data observed by the sensor installed at the front and the surrounding environment measurement data observed by the sensor installed at the rear.

In matching of FIG. 28 which results from observing the surrounding environment from the leading vehicle against FIG. 29 which results from observing the surrounding environment from the rearmost vehicle, there is little data that matches among items of surrounding environment measurement data 131 and thus greater weighting is performed for matching the surrounding environment measurement data 131 resulting from observing the surrounding environment from the leading vehicle and the rearmost vehicle against a plurality of items of surrounding environment measurement data 131 in the trackside equipment database, whereby a three-dimensional shape model for the trackside equipment 171 is obtained as in FIG. 30.

In step 505, the created three-dimensional shape model for the trackside equipment 171 is recorded in the trackside equipment database 110.

The above is a description for operation by the trackside equipment shape measurement system 104.

(Operation by Transport Vehicle Driving Control Unit 105)

Figure 31:
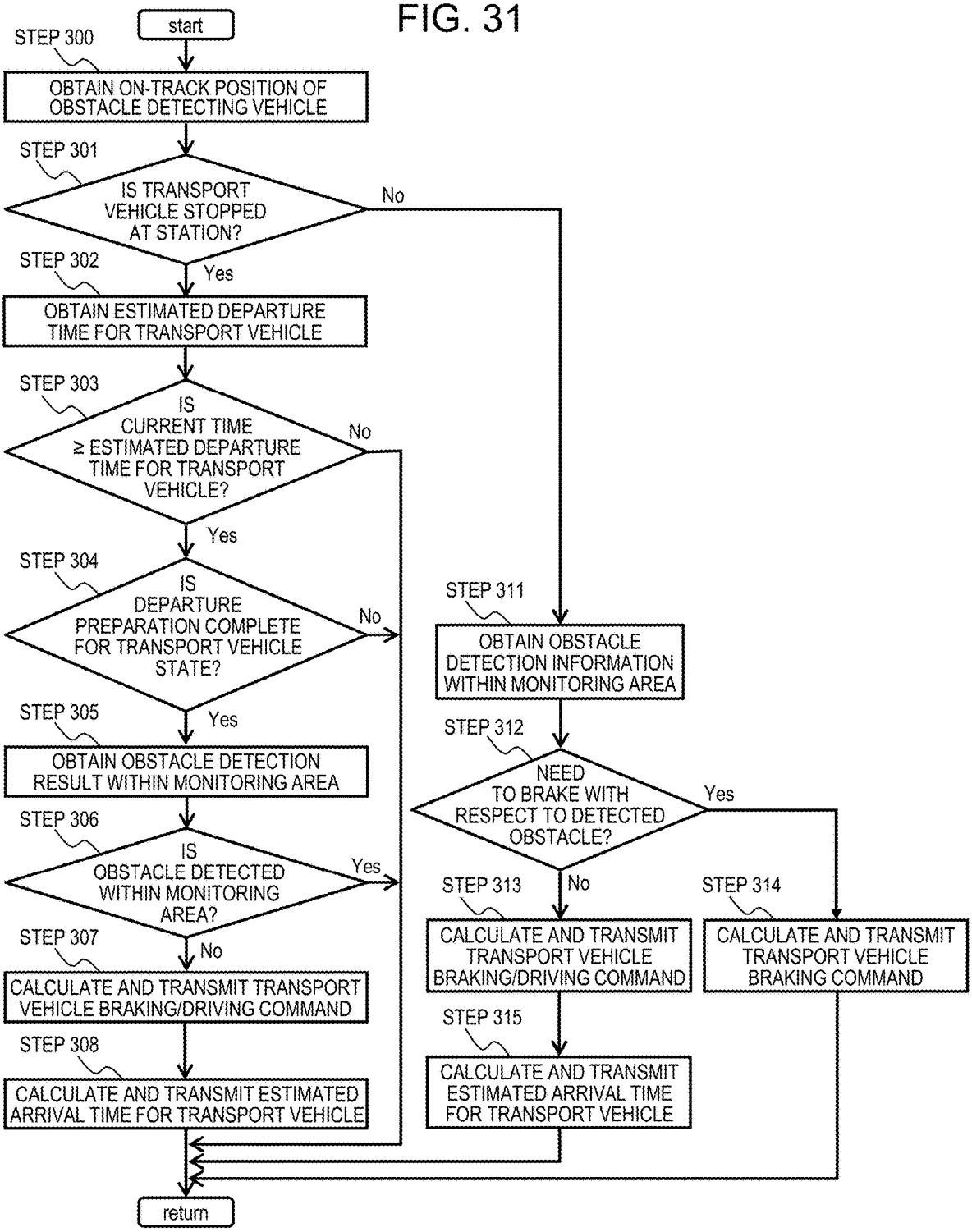
FIG. 31 is a flow chart that illustrates an example of a processing procedure for a transport vehicle driving control unit.

Next, operation by transport vehicle driving control unit 105 will be described. FIG. 31 is a flow chart that illustrates an example of a processing procedure executed by a transport vehicle driving control unit. Here, description for an example in which the obstacle detection information 145 includes information pertaining to the necessity of braking the transport vehicle 102, and the transport vehicle driving control unit controls braking and driving for the transport vehicle 102 on the basis of the obstacle detection information 145.

Operation of the transport vehicle is controlled in steps 300 through 315. The present processing is executed at a certain cycle.

In step 300, the transport vehicle driving control unit 105 obtains the on-track position of a transport vehicle.

In step 301, a determination is made as to whether the transport vehicle 102 is stopped at a station. This determination is performed from the position and speed of the transport vehicle 102, which are held by the transport vehicle driving control unit 105. Specifically, a determination of being stopped at a station is made if the position is near the station and the speed is zero.

In a case where a determination of being stopped at a station is made in step 301, in step 302, an estimated time (transport vehicle estimated departure time) when the transport vehicle 102 will depart from the station where the transport vehicle 102 is currently stopped at is obtained. The transport vehicle estimated departure time may be obtained from an operation management system (not illustrated).

In step 303, a determination is made as to whether the current time is after the transport vehicle estimated departure time. In a case of not being after, the present processing flow is ended. In a case of being after, step 304 is advanced to.

In step 304, it is determined whether the transport vehicle 102 has completed departure preparation. It is possible to give, inter alia, confirming a closed state for vehicle doors as an example of departure preparation. In a case of not being complete, the present processing flow is ended. In a case where departure preparation is complete, step 305 is advanced to.

In step 305, the obstacle detection information 145 is obtained from the obstacle detection unit 115.

In step 306, from the obstacle detection information 145, a determination is made as to whether there is an obstacle on the track. Step 307 is advanced to in a case where it is determined that there is no obstacle.

In a case where it is determined in step 306 that there is an obstacle, it is necessary to postpone departure and thus the present processing flow is ended.

In step 307, a transport vehicle braking/driving command 146 is calculated and transmitted to the transport vehicle braking/driving unit 106. Specifically, a power travel command for departing the station is transmitted here.

Next, in step 308, an estimated arrival time (transport vehicle estimated arrival time) for the next station is calculated from the timing at which the transport vehicle 102 departed and the estimated amount of travel time to the station which is to be traveled to, and the estimated arrival time is transmitted to the operation management system (not illustrated).

Next, processing (step 311 through step 315) for a case where the transport vehicle 102 is not stopped at a station in step 301 is described.

In step 311, the obstacle detection information 145 for within a monitoring area is obtained from the obstacle detection system 103.

In step 312, the necessity for the transport vehicle 102 to brake is determined on the basis of the obstacle detection information 145, and step 314 is advanced to in a case where it is determined that there is a need to brake. Step 313 is advanced to in a case where it is determined that there is no obstacle or there is no need to brake.

In step 313, a transport vehicle braking/driving command 146 is calculated and transmitted to the transport vehicle braking/driving unit 106. Specifically, here a target speed is firstly calculated on the basis of the position of the transport vehicle 102 and a target travel pattern which is predefined. A braking/driving command 146 is calculated by, inter alia, proportional control in order for the speed of the transport vehicle 102 to become the target speed.

In step 314, a transport vehicle braking/driving command 146 is calculated and transmitted to the transport vehicle braking/driving unit 106. Specifically, a braking command for causing the transport vehicle 102 to decelerate at the maximum deceleration and stop is calculated, and the present processing flow ends.

In step 315, from the position and speed of the transport vehicle 102 at the time, a time when the transport vehicle 102 will arrive at the next station is estimated and transmitted to the operation management system (not illustrated).

The above is a description of operation by the transport vehicle driving control unit 105.

The above is a description for the track transportation system 100.

In the present embodiment, it is possible to create a three-dimensional shape model close to the entire perimeter of trackside equipment because the shape of the trackside equipment is measured using surrounding environment measurement data observed by the sensor installed at the front and the surrounding environment measurement data observed by the sensor installed at the rear.

In addition, it is possible to detect an anomaly for trackside equipment on the basis of deviation between a created three-dimensional shape model for the trackside equipment and design data for the trackside equipment.

Second Embodiment

The present embodiment measures a trackside equipment shape instead of obtaining a self position for a transport vehicle 102 in an external coordinate system in the trackside equipment shape measurement system 104 according to the first embodiment.

Figure 32:
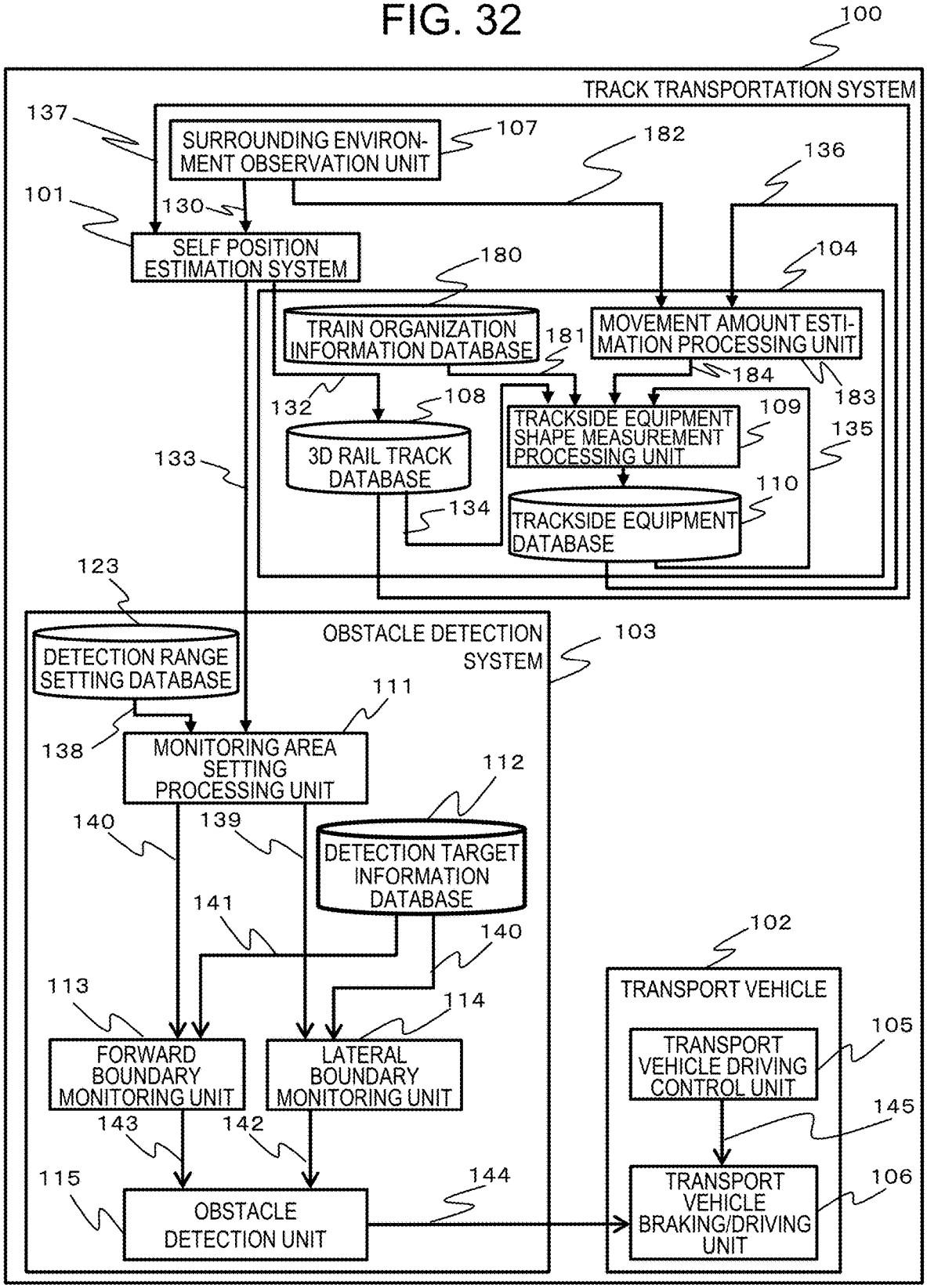
FIG. 32 is a view that illustrates an example of a configuration of a trackside equipment shape measurement system in a second embodiment.

FIG. 32 is a view that illustrates an example of a configuration for a trackside equipment shape measurement system 104 according to a second embodiment.

The trackside equipment shape measurement system 104 is configured from a three-dimensional rail track database 108, a train organization information database 180, a movement amount estimation processing unit 183, a trackside equipment shape measurement processing unit 109, and a trackside equipment database 110.

In the trackside equipment shape measurement system 104, the trackside equipment shape measurement processing unit 109 measures a three-dimensional shape for trackside equipment from point cloud data for the trackside equipment on the basis of a rail shape model 134 recorded in the three-dimensional rail track database 108, train organization information 181 recorded in the train organization information database 180, and a train movement amount 184 estimated by the movement amount estimation processing unit 183, and records the three-dimensional shape in the trackside equipment database 110.

The movement amount estimation processing unit 183 can obtain an estimated train movement amount 184 on the basis of surrounding environment observation data 182 and trackside equipment information 136.

The trackside equipment shape measurement processing unit 109 can detect trackside equipment that is within the surrounding environment observation data 182 from the rail shape model 134, the train organization information 181, the estimated train movement amount 184, and the trackside equipment information 135, and create a three-dimensional shape model for the trackside equipment.

From the rail shape model 134 (rail track), the train organization information 181 (train length), and the estimated train movement amount 184 (train speed), the trackside equipment shape measurement processing unit 109 can calculate an amount of time from trackside equipment being observed by a sensor installed at the front to the same trackside equipment being observed by a sensor installed at the rear, and use this amount of time to detect the trackside equipment within the surrounding environment observation data 182.

In other words, the trackside equipment shape measurement system obtains a three-dimensional shape for trackside equipment by overlapping a plurality of items of surrounding environment observation data that includes trackside equipment inferred to be the same object, from the train speed and the train length. More specifically, the trackside equipment shape measurement system infers the same object on the basis of the train speed, the rail track, and the train organization.

By virtue of the present embodiment, shape measurement for trackside equipment is possible even in an environment in which self position estimation in an external coordinate system is difficult, such as in a tunnel.

Note that the present invention is not limited to the embodiments described above, and includes various variations. For example, the embodiments described above are described in detail in order to describe the present invention in an easy-to-understand manner, and there is not necessarily a limitation to something provided with all configurations that are described. In addition, a portion of a configuration of an embodiment can be replaced by a configuration of another embodiment, and it is also possible to add a configuration of another embodiment to a configuration of an embodiment. In addition, with respect to a portion of the configuration of each embodiment, it is possible to effect deletion, replacement by another configuration, or addition of another configuration.

DESCRIPTION OF REFERENCE CHARACTERS

100: Track transportation system
101: Self position estimation system
102: Transport vehicle
103: Obstacle detection system
104: Trackside equipment shape measurement system
105: Transport vehicle driving control unit
106: Transport vehicle braking/driving unit
107: Surrounding environment observation unit
108: Three-dimensional rail track database
109: Trackside equipment shape measurement processing unit
110: Trackside equipment database
111: Monitoring area setting processing unit
112: Detection target information database
113: Forward boundary monitoring unit
114: Lateral boundary monitoring unit
115: Obstacle detection unit
116: Observation data sorting processing unit
117: Vehicle orientation estimation processing unit
118: Surrounding environment data coordinate conversion processing unit
119: Surrounding environment map generation processing unit
120: Surrounding environment map database
121: Scan-matching self position estimation processing unit
123: Detection range setting database
130: Surrounding environment observation data
131: Surrounding environment measurement data
132: Rail measurement data
133: Position and orientation information for transport vehicle
134: Rail shape model
135: Trackside equipment information
136: Trackside equipment information
137: Rail position information
138: Obstacle detection range
139: Lateral boundary detection region
140: Forward boundary detection region
141: Lateral detection target information
142: Forward detection target information
143: Lateral boundary monitoring result
144: Forward boundary monitoring result
145: Obstacle detection information
146: Transport vehicle braking/driving command
147: Rail observation data
149: Vehicle orientation
150: Vehicle orientation
151: Surrounding environment measurement data
152: Surrounding environment measurement data
153: Surrounding environment map data
155: Lateral boundary detection region
156: Forward boundary detection region
171: Trackside equipment
172: Trackside equipment measurement data
173: Surrounding environment measurement data origin set on rail track
180: Train organization information database
181: Train organization information
182: Surrounding environment observation data
183: Movement amount estimation processing unit
184: Estimated train movement amount
185: Rail track

The invention claimed is:

1. A track transportation system, comprising:

a surrounding environment observation unit that is installed on a train and including at least one of a camera, a laser radar, or a millimeter-wave radar, the surrounding environment observation unit configured to obtain surrounding environment observation data by observing a surrounding environment that is for while the train is traveling and includes known trackside equipment; and a trackside equipment shape measurement system configured to obtain a three-dimensional shape for the trackside equipment by overlapping, on a basis of a shape model for a rail, a plurality of items of the surrounding environment observation data that include the trackside equipment and have been obtained at a plurality of positions on a track;

wherein the trackside equipment shape measurement system is configured to:

obtain the three-dimensional shape for the trackside equipment by, on a basis of (i) a result of matching observation data that is for the rail and is included in the surrounding environment observation data against the shape model for the rail and (ii) a result of matching measurement data that is for the trackside equipment and is included in the surrounding environment observation data against the three-dimensional shape for the trackside equipment, and overlap, based on the matching results, the plurality of items of the surrounding environment observation data that include the trackside equipment.

2. The track transportation system according to claim 1, wherein the surrounding environment observation unit is installed at a front and a rear of the train.

3. The track transportation system according to claim 2, wherein the trackside equipment shape measurement system obtains the three-dimensional shape for the trackside equipment by overlapping the plurality of items of the surrounding environment observation data that include the trackside equipment that is inferred to be a same object, from a speed for the train and a length of the train.

4. The track transportation system according to claim 3, wherein the trackside equipment shape measurement system infers the same object on a basis of a speed for the train, the track for the rail, and an organization of the train.

5. The track transportation system according to claim 1, wherein the surrounding environment observation unit is installed at a front and a rear of the train.

6. The track transportation system according to claim 5, wherein the trackside equipment shape measurement system obtains the three-dimensional shape for the trackside equipment by overlapping the plurality of items of the surrounding environment observation data that include the trackside equipment that is inferred to be a same object, from a speed for the train and a length of the train.

7. A method of controlling a track transportation system provided with a surrounding environment observation unit installed on a train and including at least one of a camera, a laser radar, or a millimeter-wave radar, and a trackside equipment shape measurement system, the method comprising:

a step of obtaining, by the surrounding environment observation unit, surrounding environment observation data by observing a surrounding environment that is for while the train is traveling and includes known trackside equipment; and a step of obtaining, by the trackside equipment shape measurement system, a three-dimensional shape for the trackside equipment by overlapping, on a basis of a shape model for a rail, a plurality of items of the surrounding environment observation data that include the trackside equipment and have been obtained at a plurality of positions on a track;

wherein the step of obtaining the three-dimensional shape of the trackside equipment:

obtains the three-dimensional shape for the trackside equipment by, on a basis of (i) a result of matching observation data that is for the rail and is included in the surrounding environment observation data against the shape model for the rail and (ii) a result of matching measurement data that is for the trackside equipment and is included in the surrounding environment observation data against the three-dimensional shape for the trackside equipment, and overlaps, based on the matching results, the plurality of items of the surrounding environment observation data that include the trackside equipment.

8. The method according to claim 7, wherein the surrounding environment observation unit is installed at a front and a rear of the train.

9. The method according to claim 8, wherein the step of obtaining the three-dimensional shape of the trackside equipment obtains the three-dimensional shape for the trackside equipment by overlapping the plurality of items of the surrounding environment observation data that include the trackside equipment that is inferred to be a same object, from a speed for the train and a length of the train.

10. The method according to claim 9, wherein the step of obtaining the three-dimensional shape of the trackside equipment infers the same object on a basis of the speed for the train, the track for the rail, and an organization of the train.

11. The method according to claim 7, wherein the surrounding environment observation unit is installed at a front and a rear of the train.

12. The method according to claim 11, wherein the step of obtaining the three-dimensional shape of the trackside equipment obtains the three-dimensional shape for the trackside equipment by overlapping the plurality of items of the surrounding environment observation data that include the trackside equipment that is inferred to be a same object, from a speed for the train and a length of the train.

13. A trackside equipment shape measurement system for obtaining a three-dimensional shape of trackside equipment relative to a rail, the system comprising:

a trackside equipment shape measurement processing unit configured to obtain a three-dimensional shape for trackside equipment is obtained by overlapping, on a basis of a shape model for the rail, a plurality of items of surrounding environment observation data that include known trackside equipment and have been obtained at a plurality of positions on a track; and the trackside equipment shape measurement processing unit further configured to obtain the three-dimensional shape for the trackside equipment by:

selecting the plurality of items, on a basis of (i) a result of matching observation data that is for the rail and is included in the surrounding environment observation data against the shape model for the rail and (ii) a result of matching measurement data that is for the trackside equipment and is included in the surrounding environment observation data against the three-dimensional shape for the trackside equipment, and overlapping, based on the matching results, the plurality of items of the surrounding environment observation data that include the trackside equipment.

14. The trackside equipment shape measurement system according to claim 13, wherein the surrounding environment observation data is obtained by a surrounding environment observation unit installed at a front and a rear of a train.

15. The trackside equipment shape measurement system according to claim 14, wherein the three-dimensional shape for the trackside equipment is obtained by overlapping a plurality of items of the surrounding environment observation data that include the trackside equipment that is inferred to be a same object, from a speed for the train and a length of the train.

16. The trackside equipment shape measurement system according to claim 15, wherein the same object is inferred on a basis of a speed for the train, the track for the rail, and an organization of the train.

17. The trackside equipment shape measurement system according to claim 13, wherein the surrounding environment observation data is obtained by a surrounding environment observation unit installed at a front and a rear of a train.

* * * * *